US011554890B2

(12) United States Patent
Merrill et al.

(10) Patent No.: US 11,554,890 B2
(45) Date of Patent: Jan. 17, 2023

(54) LABELING SYSTEM ADAPTED FOR LABELING SYRINGES OR VIALS

(71) Applicant: NJM PACKAGING INC., Montreal (CA)

(72) Inventors: Dale C. Merrill, Enfield, NH (US); Simon Lajoie, Montreal (CA)

(73) Assignee: NJM PACKAGING INC., Montreal (CA)

( * ) Notice: Subject to any disclaimer, the term of this patent is extended or adjusted under 35 U.S.C. 154(b) by 128 days.

(21) Appl. No.: 16/904,955

(22) Filed: Jun. 18, 2020

(65) Prior Publication Data

US 2021/0394946 A1 Dec. 23, 2021

(51) Int. Cl.
*B65C 3/10* (2006.01)
*B65C 9/04* (2006.01)

(52) U.S. Cl.
CPC . *B65C 3/10* (2013.01); *B65C 9/04* (2013.01)

(58) Field of Classification Search
CPC .... B65C 3/08; B65C 3/10; B65C 9/04; B65C 2210/0089
See application file for complete search history.

(56) References Cited

U.S. PATENT DOCUMENTS

| | | | | |
|---|---|---|---|---|
| 6,922,944 | B1 | 8/2005 | Krueger | |
| 8,052,814 | B2 | 11/2011 | Kellhammer | |
| 9,102,433 | B2 | 8/2015 | Cordiolo | |
| 9,126,709 | B2 | 9/2015 | Giuliani | |
| 2004/0099379 | A1 | 5/2004 | Erich | |
| 2005/0284735 | A1* | 12/2005 | Hartness | B65G 17/42 198/850 |
| 2008/0037045 | A1* | 2/2008 | Jacob | B65G 47/8823 358/1.9 |
| 2008/0093872 | A1* | 4/2008 | Baumstimler | B65G 47/91 901/27 |
| 2008/0156442 | A1* | 7/2008 | Meinzinger | B65C 9/0062 156/567 |
| 2009/0294070 | A1 | 12/2009 | Kellhammer | |
| 2012/0039692 | A1* | 2/2012 | Giuliani | B65C 9/40 414/222.01 |
| 2013/0139969 | A1 | 6/2013 | Giuliani | |

* cited by examiner

*Primary Examiner* — George R Koch
(74) *Attorney, Agent, or Firm* — Thompson Hine LLP

(57) ABSTRACT

A labeling system includes a drive for moving a trunnion part along a labeling path and a labeling station positioned peripherally of the labeling path. A housing assembly around the rotational drive and the labeling station forms a guarding enclosure for an interior space of the housing assembly. Multiple container infeed paths are provided for different container types, and multiple container outfeed types are provided for the different container types. Sets of change-over parts are used to configure the system for a given container type. The housing assembly may include guarding assemblies associated with the infeed and outfeed paths.

18 Claims, 25 Drawing Sheets

LABELING SYSTEM ADAPTED FOR LABELING SYRINGES OR VIALS

TECHNICAL FIELD

This application relates generally to labeling systems and, more specifically, to a labeling system adapted for selectively labeling at least two different container types, such as either vials or syringes.

BACKGROUND

The use of starwheel labeling machine is known. The labeling of different container types in such systems, particularly container types that are conveyed in a different manner, generally results in the need for different labeling machines for the different containers. For example, vials are generally supported on the vial bottom when conveyed, and syringe barrels are generally supported by the flange at the top end of the barrel when conveyed vertically. The structures used to convey one of the container types (e.g., the vial) are not compatible for conveying the other container type (e.g., the syringe barrel). The use of two different labeling machines for labeling different container types that might carry the same material (e.g., the same medicine) results in additional cost outlays and a larger footprint for the production facility.

Accordingly, labeling system adapted for labeling containers that are conveyed in different manners would be beneficial.

SUMMARY

In one aspect, a labeling system includes a drive for moving a trunnion part along a labeling path and a labeling station positioned peripherally of the labeling path. A housing assembly around the rotational drive and the labeling station forms a guarding enclosure for an interior space of the housing assembly. Multiple container infeed paths are provided for different container types, and multiple container outfeed types are provided for the different container types. Sets of changeover parts are used to configure the system for a given container type.

In one implementation, the housing assembly may include guarding assemblies associated with the infeed and outfeed paths.

In another aspect, a labeling system includes a rotational drive for rotating a starwheel assembly, a labeling station positioned for labeling of containers and a housing assembly around the rotational drive and the labeling station as a guarding enclosure for an interior space of the housing assembly. A first container infeed path through the housing assembly is provided for feeding a first container type into the interior space for labeling, a second container infeed path through the housing assembly is provided for feeding a second container type into the interior space for labeling, a first container outfeed path is provided through the housing assembly for feeding the first container type out of the interior space after labeling and a second container outfeed path is provided through the housing assembly for feeding the second container type out of the interior space after labeling. The labeling station is positioned peripherally of the rotational drive at a location that is, in top plan view, both (i) circumferentially between the first infeed path and the first outfeed path and (ii) circumferentially between the second infeed path and the second outfeed path.

In a further aspect, a labeling system includes a labeling station positioned for labeling of containers; a housing assembly around the labeling station as a guarding enclosure for an interior space of the housing assembly; a first container infeed path through the housing assembly for feeding a first container type into the interior space for labeling; a second container infeed path through the housing assembly for feeding a second container type into the interior space for labeling; a first container outfeed path through the housing assembly for feeding the first container type out of the interior space after labeling; and a second container outfeed path through the housing assembly for feeding the second container type out of the interior space after labeling. The first container infeed path and the second container infeed path are located on an infeed side of the housing assembly and alongside each other, wherein the first container infeed path is through a first housing assembly infeed opening and the second container infeed path is through a second housing assembly infeed opening. The housing assembly includes a first guard assembly located at the infeed side, wherein the first guard assembly includes a first panel movable between a first guarding position and a second guarding position. In the first guarding position, the first panel blocks the first housing assembly infeed opening and does not block the second housing assembly infeed opening. In the second guarding position, the first panel blocks the second housing assembly infeed opening and does not block the first housing assembly infeed opening.

The details of one or more embodiments are set forth in the accompanying drawings and the description below. Other features, items, and advantages will be apparent from the description and drawings, and from the claims.

DETAILED DESCRIPTION

Figure 1:
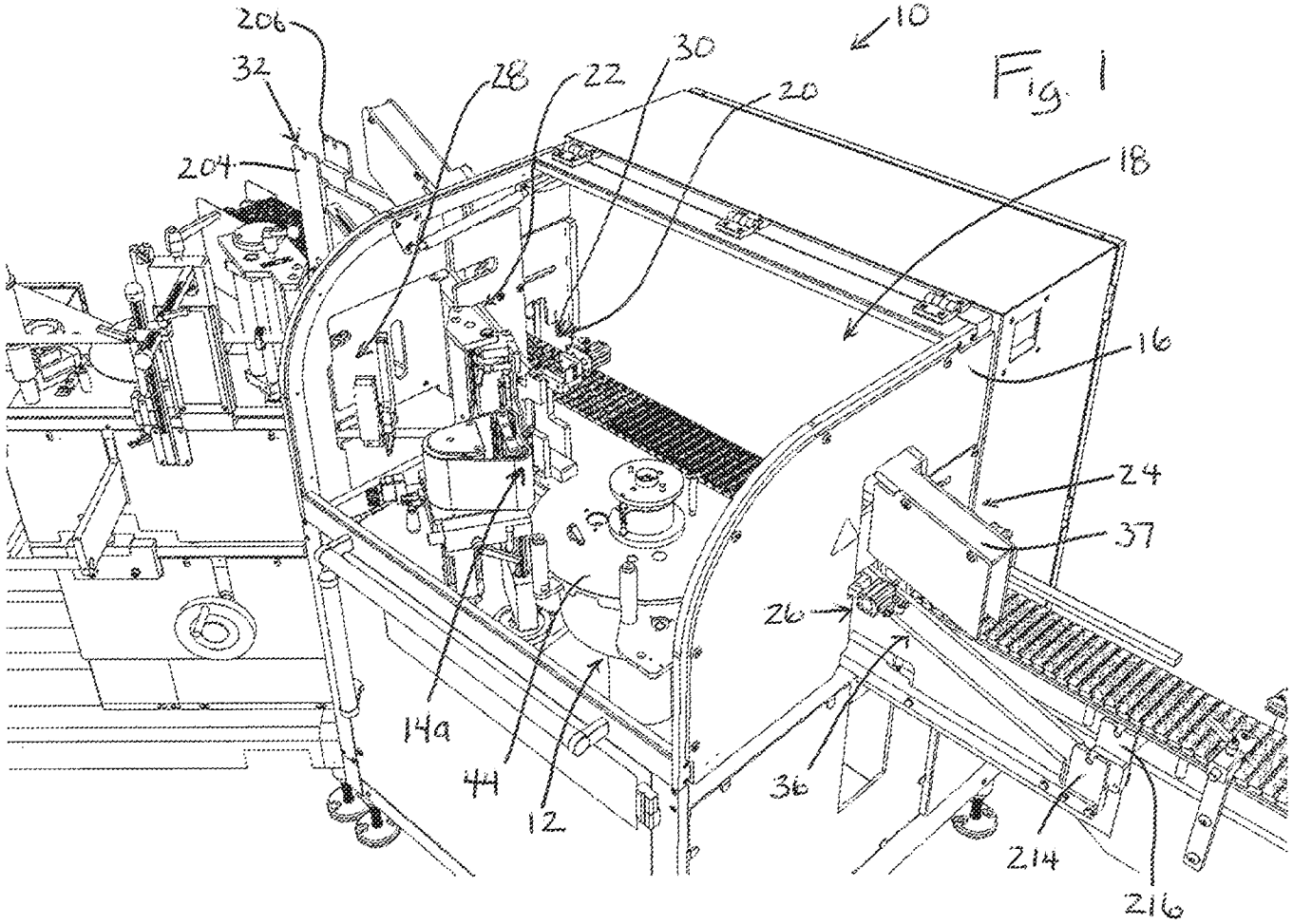
FIGS. 1 and 2 show perspective views of a labeling system base configuration.

FIGS. 1-4 show a labeling system 10 that is adapted for ready changeover between labelling vials and labeling syringes, and vice versa. The labeling system 10 includes a rotational drive assembly 12 for rotating a starwheel assembly (not shown), and a labeler 14 that feeds labels to a labeling station 14*a* that is positioned for labeling of containers that are being rotated past the label by the starwheel assembly. A housing assembly 16 is positioned around the rotational drive assembly 12 and the labeling station 14*a* as a guarding enclosure for internal space 18, and the upper front portion of the housing is removed to show the internal space 18. A vial infeed path 20 is provided through the housing for feeding vials into the enclosure for labeling, and a syringe infeed path 22 is provided through the housing for feeding vials into the enclosure for labeling, it being recognized that for a given set-up only one of the paths would be used. A vial container outfeed path 24 is provided through the housing for feeding labeled vials out of the enclosure after labeling, and a syringe outfeed path 26 is provided through the housing for feeding labeled syringes out of the enclosure after labeling. The labeling station 14*a*, which here includes a wrap-belt, is positioned peripherally of the rotational drive assembly at a location that is, in top plan view, both (i) circumferentially between the vial infeed path and the first outfeed path and (ii) circumferentially between the second infeed path and the second outfeed path. A label infeed path 28 is also provided through the housing for feeding labels to the labeling station 14*a*. Here, the sequence of paths through the housing, moving counterclockwise in top plan view, is vial infeed path, syringe infeed path, label infeed path, syringe outfeed path and vial outfeed path, but other variations are possible.

The vial infeed path 20 includes a conveyor segment 30 passing through the housing (e.g., vials can sit on the conveyor segment during infeed). The syringe infeed path 22 includes a downwardly inclined rail mount frame 32 passing through the housing (e.g., which can receive a rail set for transporting syringes by the barrel flange). The vial outfeed path 24 includes a conveyor segment 34 passing through the housing, and the syringe outfeed path 26 includes a downwardly inclined rail mount frame 36 passing through the housing. An upper syringe path housing cover 37 at the exterior of the housing assembly is also shown. Here, the two conveyor segments 30 and 34 are formed by different sections of a single conveyor 40 (e.g., a looped belt conveyor) that passes all the way through the enclosure from the vial infeed path 20 to the vial outfeed path 24.

The rotational drive assembly 12 include a drive mount hub 42 extending above an opening (not shown) in a stationary plate 44, and a drive system 46 (e.g., motor etc.) located below the stationary plate and having a drive connection with the drive mount hub through the plate opening.

The wrap-belt of the labeling station 14*a* is mounted on an adjustment stand, with one handle (not shown) that is releasable to enable height adjustment of the belt position (e.g., by movement along vertical slide rods, per arrow 54) and one handle 56 that is releasable to enable lateral adjustment of the belt position (e.g., by movement along horizontal slide rods, per arrow 58). Handle 52 provides quick-release of the tension in the wrap-belt to permit belt replacement.

Notably, in FIGS. 1-4, the labeling system is shown without specific parts that are needed for labeling vials and without specific parts that are needed for labeling syringes. The labeling system 10 includes changeover parts for this purpose, enabling the system to be assembled in a format configured for vial labeling or assembled in a format configured for syringe labeling. The different changeover part sets are described below.

FIGS. 5-8 show a set of changeover components 60 that are assembled into the system of FIGS. 1-4 for the purpose of the vial labeling format. The vial changeover components 60 include a vial starwheel assembly 62 (with spaced apart upper and lower plates having peripheral slots for engaging with vials, where each slot and adjacent pair of roller wheels that facilitate vial rotation during labeling). An infeed guide assembly 64 that defines a vial slot path 66 to divert and direct vials from the conveyor 40 (not shown) radially toward the vial starwheel assembly 62, and also includes a retaining segment 68 with an arcuate surface facing and extending partially around the vial starwheel assembly 62 toward the labeling station position (represented by gap 70) for maintaining vials in contact with the vial starwheel assembly 62 as they move toward the labeling station. On the other side of the gap 70, an arcuate retaining arm 72 is provided for maintaining vials in contact with the vial starwheel assembly 62 after labeling, followed by a gate 74 and an outfeed guide assembly 76. The gate 74 is shown in a closed position that maintains labeled vials in contact with the vial starwheel assembly 62 as the vials move toward the outfeed guide assembly, but can be rotated to an open position that allows the vials to fall away from the vial starwheel assembly 62 (e.g., into a discard chute/path) if the vials are defective (e.g., if the label was not applied or was misapplied as determined by a sensing system (e.g., a camera or other optical system). The outfeed guide assembly 76 defines a slot path 78 that separates the labeled vials from the starwheel assembly and directs them into alignment with movement of the conveyor 40 (not shown) for final outfeed. The changeover components 60 also include an arcuate support rail 80 for supporting the bottoms of container being moved by the vial starwheel assembly 62. Once assembled into the base system, of the above vial changeover components, only the vial starwheel assembly 62 rotates during labeling operations. The remaining components remain stationary, except for occasional operation of the gate 74.

Figure 9:
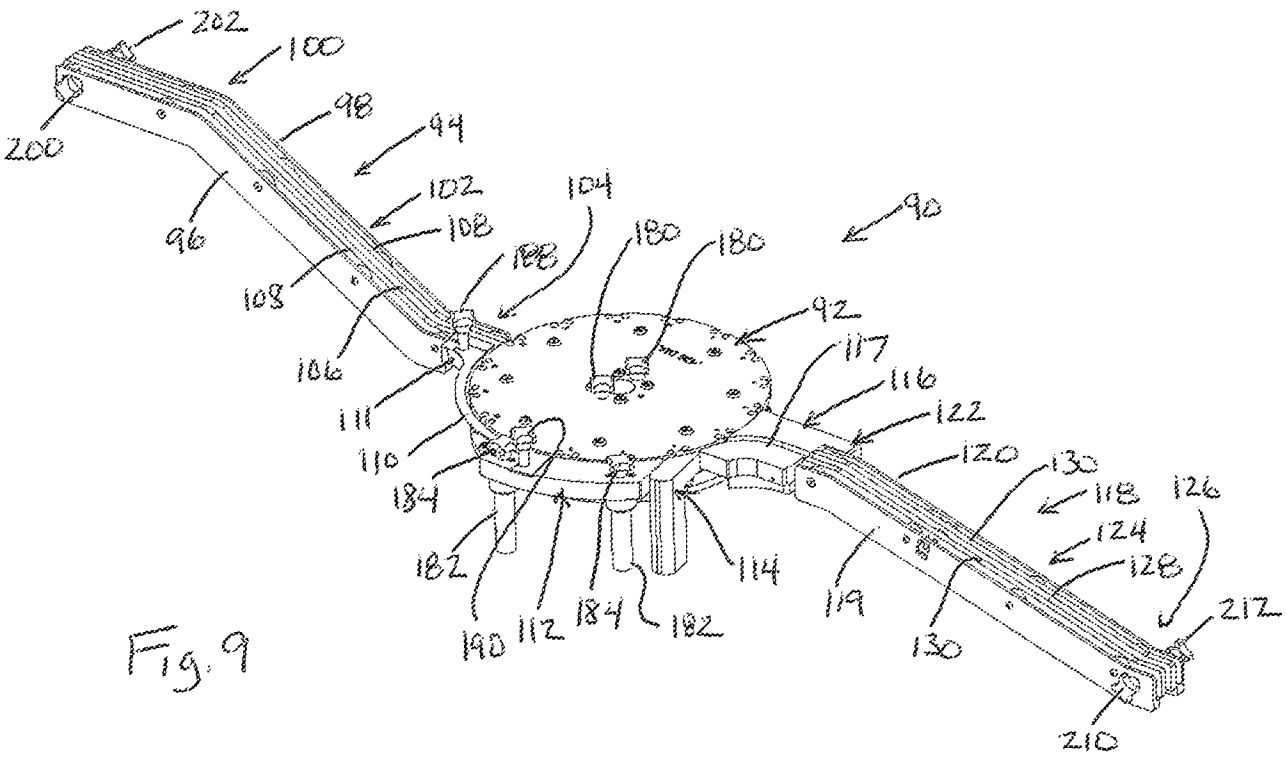
FIGS. 9-11 show a set of changeover parts for a syringe format of the labeling system.
Figure 10:
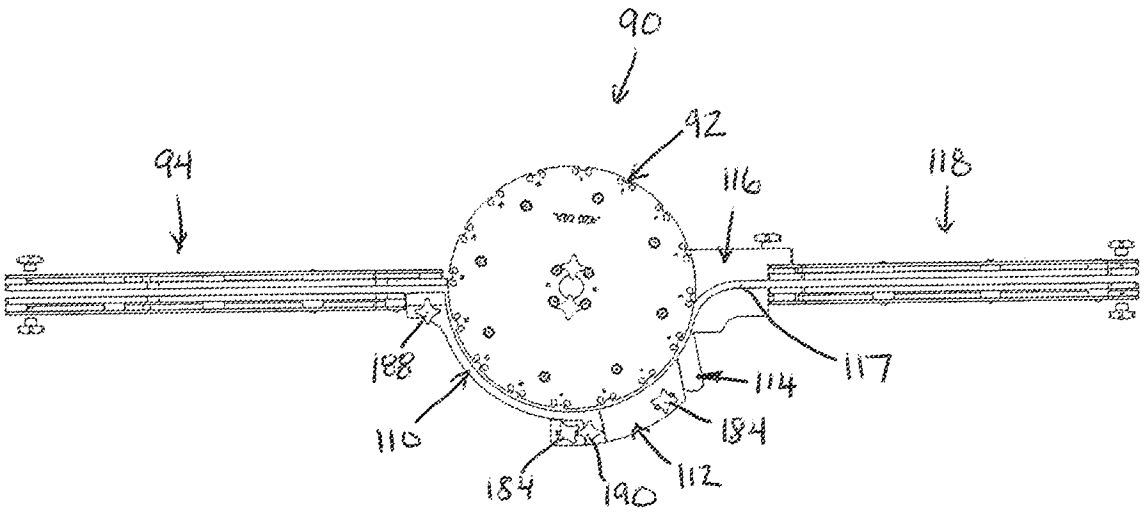
Figure 11:
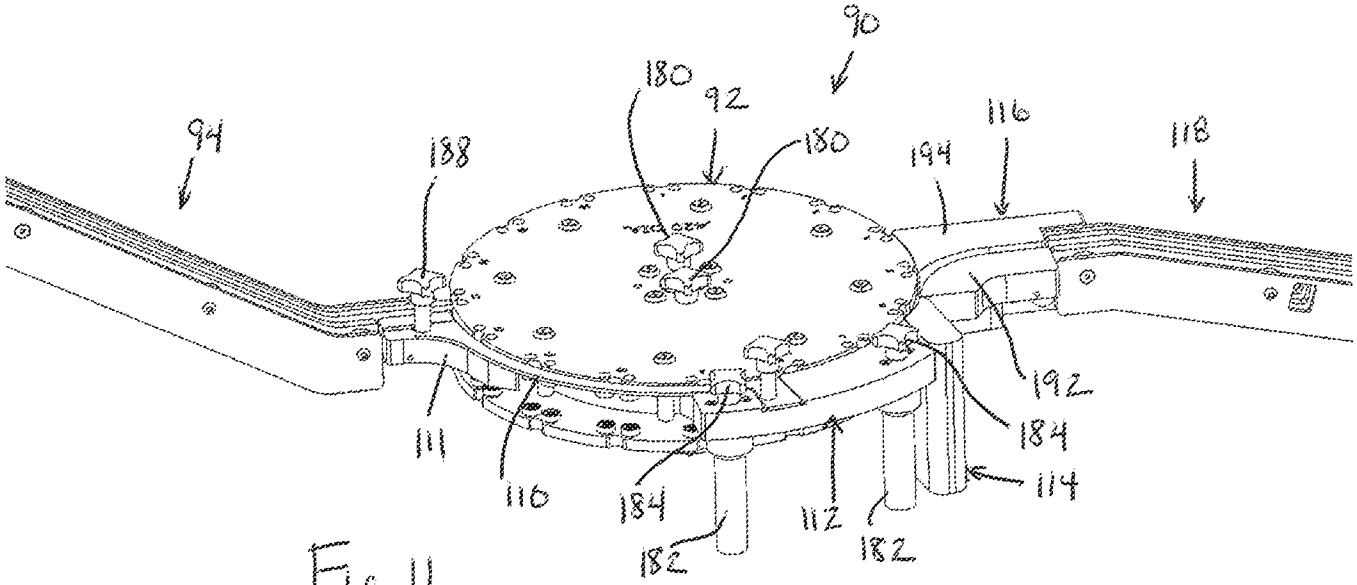

FIGS. 9-11 show a set of changeover components 90 that are assembled into the system of FIGS. 1-4 for the purpose of the syringe labeling format. The syringe changeover components 90 include a syringe starwheel assembly 92 (with spaced apart upper and lower plates having peripheral slots for engaging with syringes, where each slot includes an adjacent pair of roller wheels that facilitate syringe rotation during labeling). An infeed rail set 94 includes two rails 96 and 98 that mount to the spaced apart frame sections of the rail mount frame 32 (not shown). The rails include inlet segments 100, downwardly angled feed segments 102 and end segments 104. The rail 96, 98 fit down between the frame sections and define a gap 106 and upwardly facing slide surfaces 108 to support the barrel flanges of the syringes (e.g., needle end of the syringe barrel pointing downward). The end segments of the rails 96, 98 direct the syringes into engagement with the syringe starwheel assembly 92. An arcuate retaining plate 110 is supported at one end by a mount 111, extends around the starwheel assembly 92, across gap 70' (where the labeling station is located to label syringes), and is supported at the other end by an arcuate retaining arm 112, followed by a gate 114, an outfeed diverter 116 and an outfeed rail set 118. The upper surfaces of the plate 110, arm 112, gate 114 and outfeed diverter 116 act as support surfaces, in cooperation with the upper surface of the syringe starwheel assembly such that the barrel flange can be supported on such surfaces during transport by the starwheel assembly 92, until the syringes are fully supported by the outfeed diverter 116, which defines slot path 117, and then delivered to the outfeed rail set 118. The outfeed rail set 118 includes two rails 119 and 120 that mount to the spaced apart frame sections of the rail mount frame 36 (not shown).

The rails include inlet segments 122, downwardly angled feed segments 124 and end segments 126. The rail 96, 98 fit down between the frame sections (not shown) and define a gap 128 and upwardly facing slide surfaces 130 to support the barrel flanges of the syringes. Once assembled into the base system, of the above syringe components, only the syringe starwheel assembly 92 rotates during labeling operations. The remaining components remain stationary, except for occasional operation of the gate 114.

Notably, both the vial component set 60 and the syringe component set 90 are configured, along with the base system shown in FIGS. 1-4, to enable changeover without requiring the use of any tools, as described in more detail below.

Figure 2:
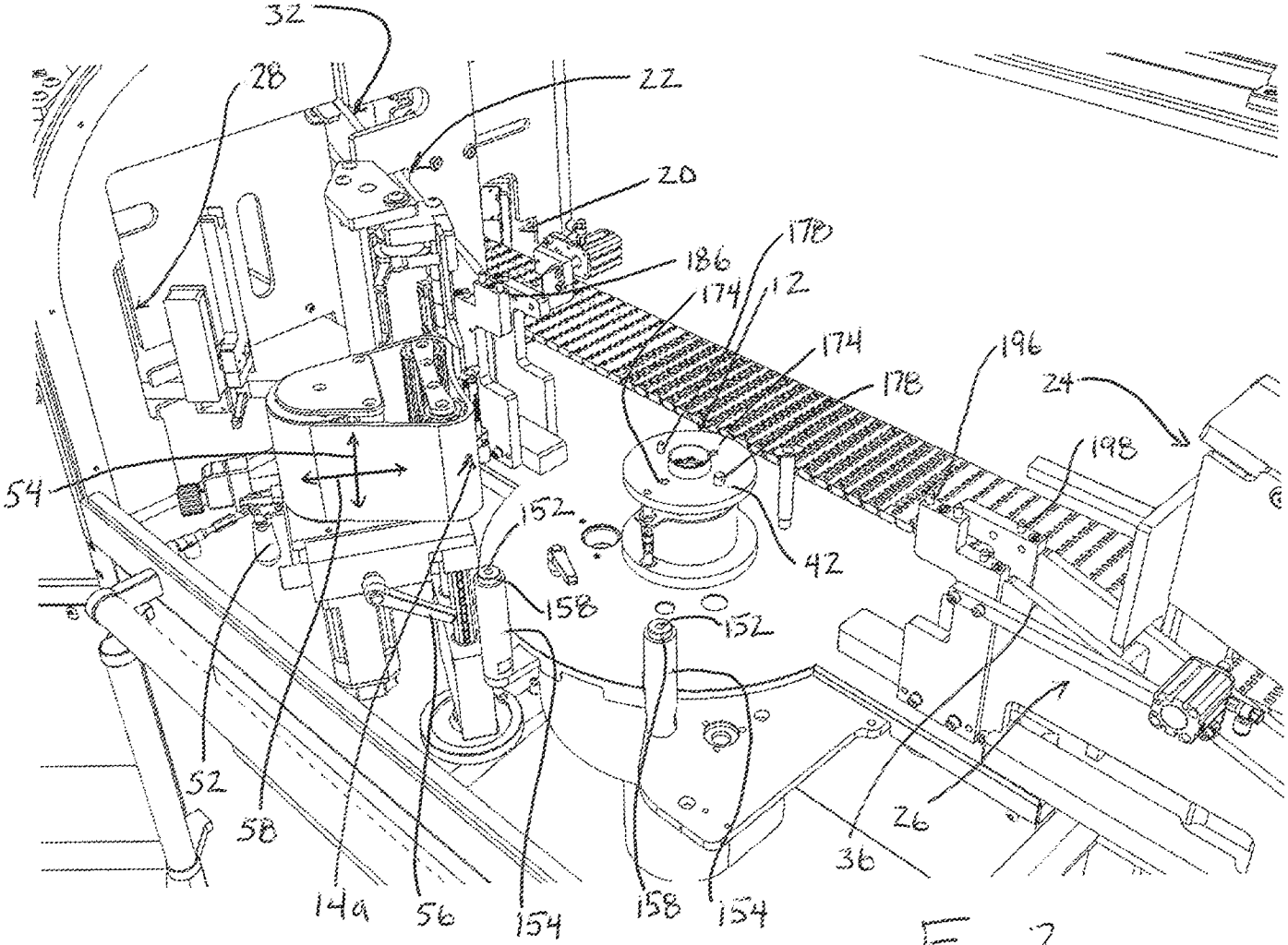
Figure 3:
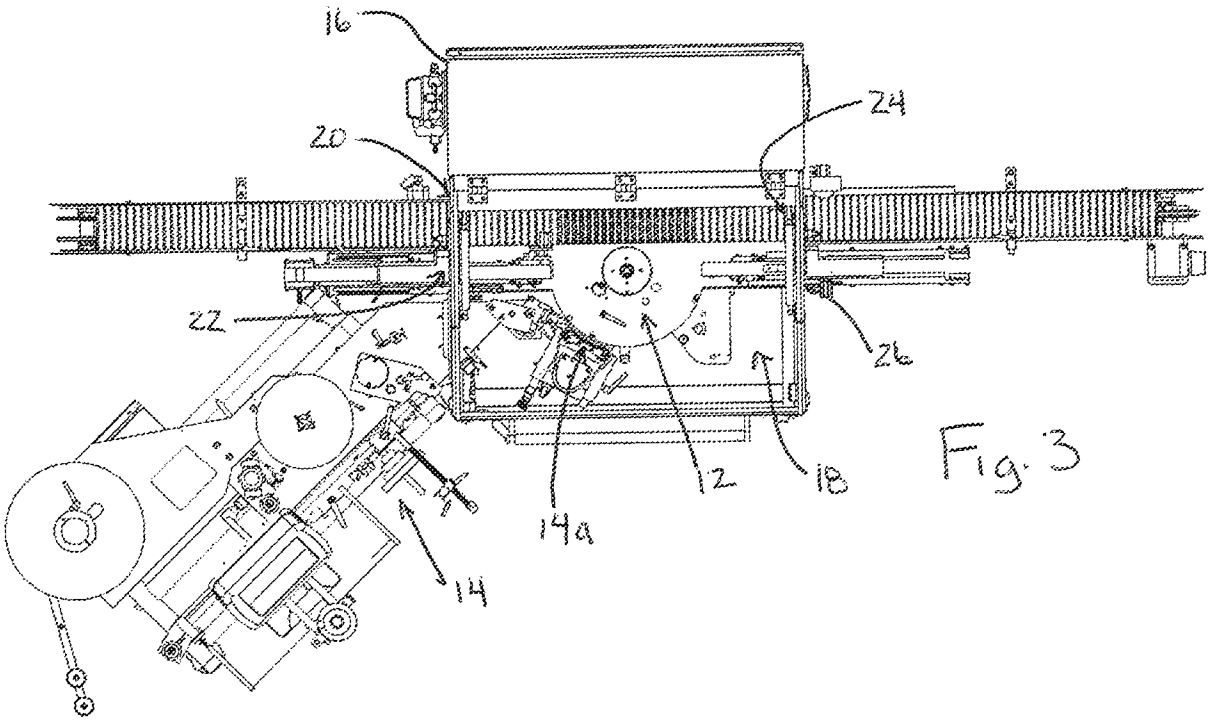
FIGS. 3 and 4 shows top plan views of the labeling system.
Figure 4:
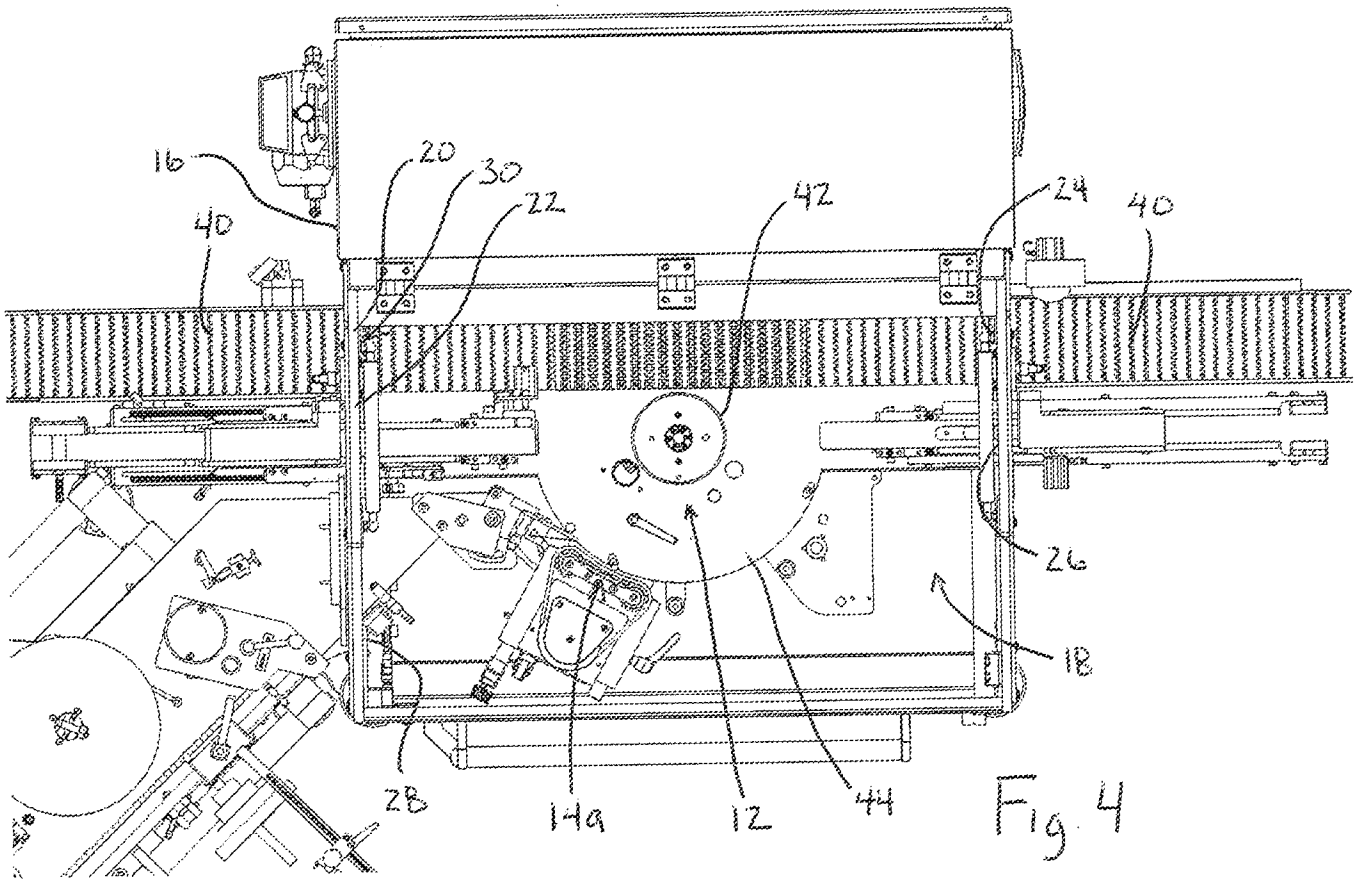
Figure 5:
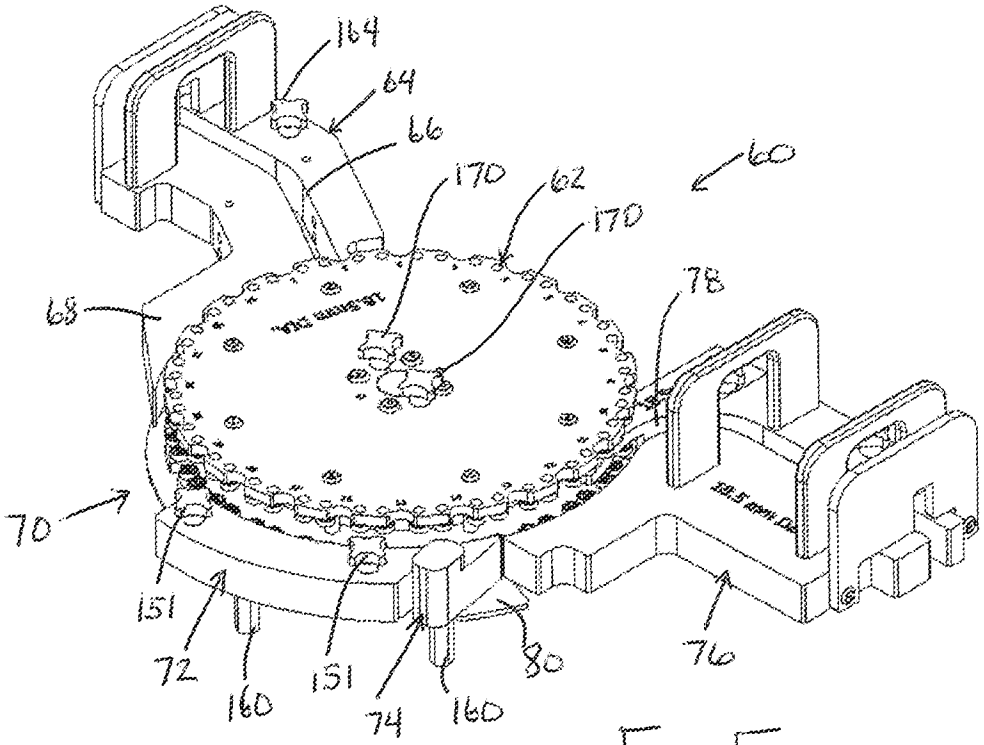
FIGS. 5-8 show a set of changeover parts for a vial format of the labeling system.
Figure 6:
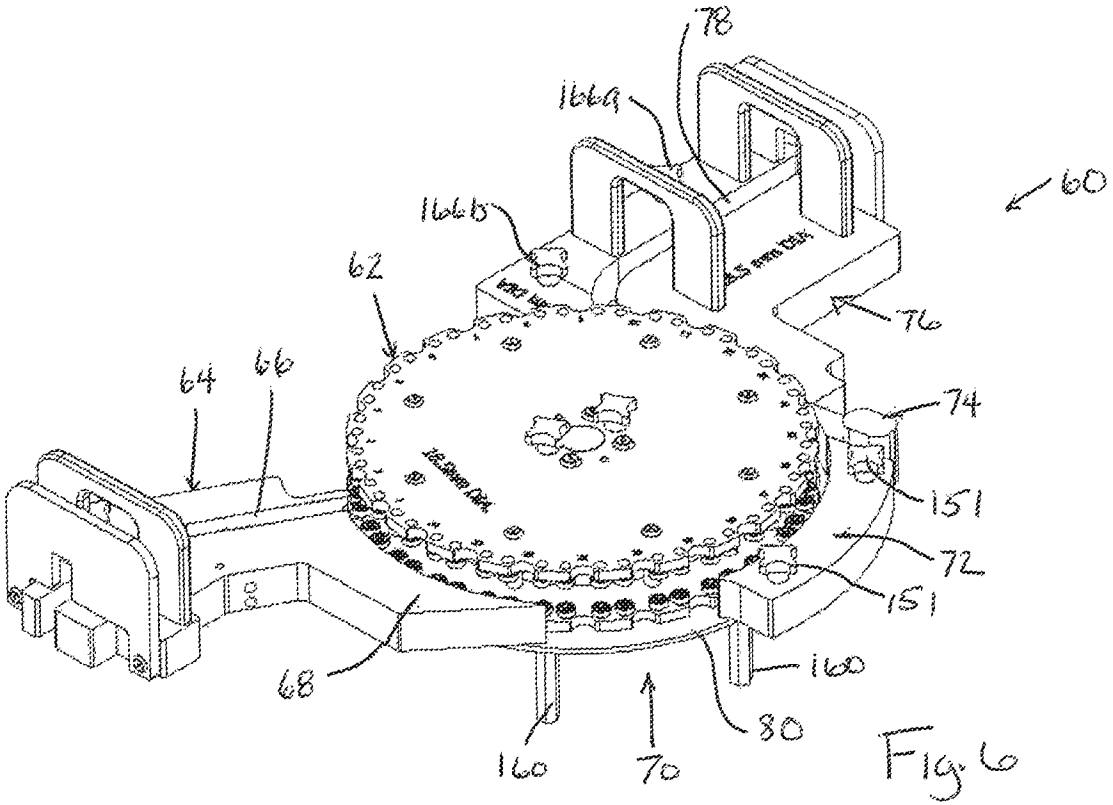
Figure 7:
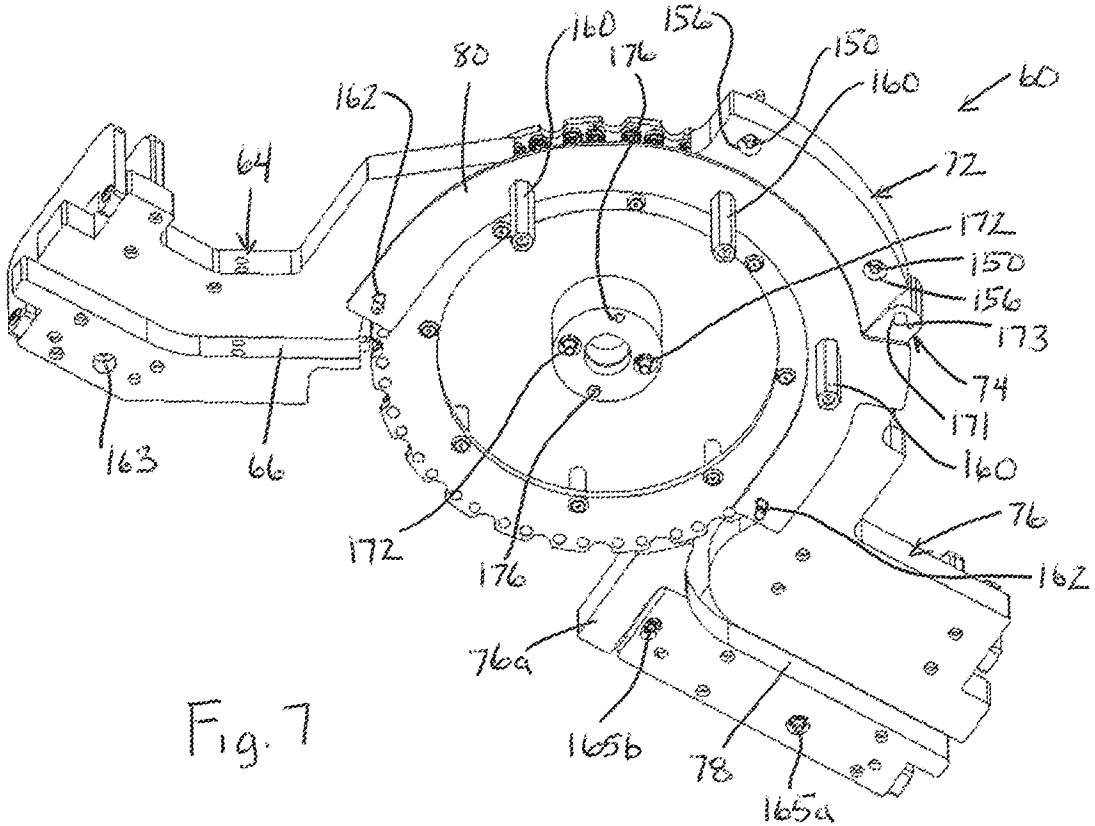
Figure 8:
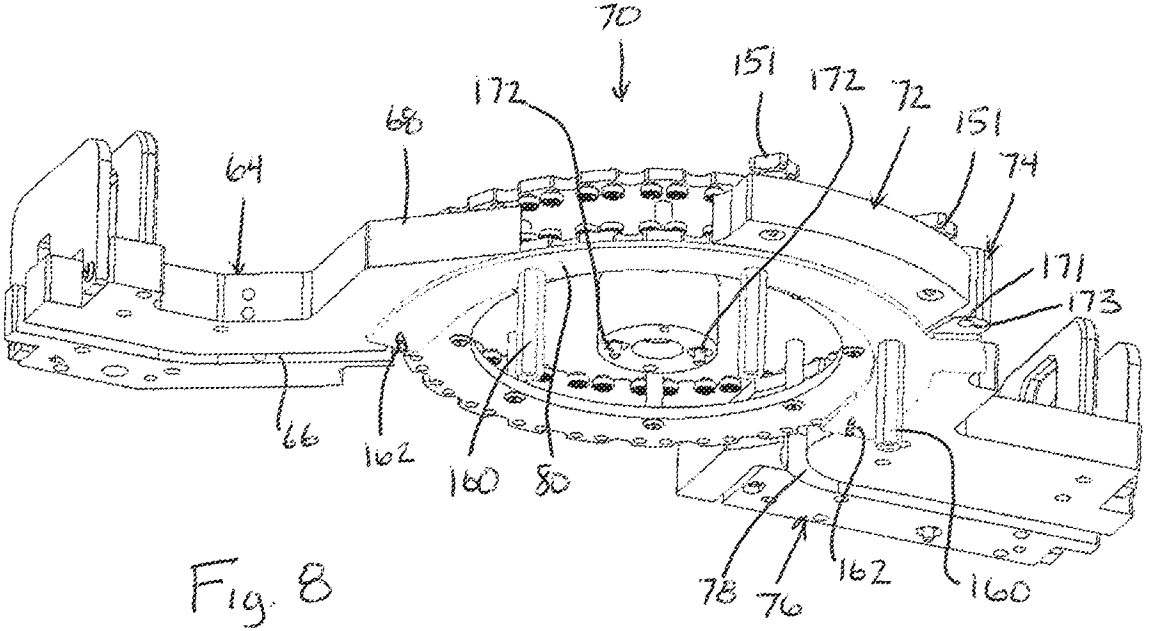

Referring to vial changeover component set 60 in FIGS. 5-8 and the base system of FIGS. 1-4, the retaining arm 72 includes a pair of spaced apart bolts 150 extending down through the arm and having lower threaded distal ends for threaded engaging into threaded openings 152 at the tops of support rods 154 of the base system (see FIG. 2). The openings 156 at the bottom surface of the retaining arm 72 are also configured to matingly receive the bosses 158 at the tops or the rods 154 to facilitate the connection. The upper ends of the bolts 150 have grip handles 151 to facilitate connection/disconnection of the retaining arm 72 by rotation. The support plate 80 includes downwardly extending support legs 160 that rest atop the stationary plate 44 when the support plate 80 is installed. The distal ends of the support plate 80 may include downwardly extending pins 162 for seating within openings of frame portions of the base system. Magnets (not shown) may be incorporated into the bottom ends of the legs 160 and/or pins 162 to retain the support plate 80 in place in a suitable manner during system operation, but which retention force can be overcome by pulling the support plate 80 upward. The infeed guide assembly 64 includes a downwardly extending through bolt 163 with upper grip handle 164 for connecting/disconnecting the infeed guide assembly in the base system (e.g., by threaded engagement of the bolt with a frame opening), and the outfeed guide assembly 76 includes a downwardly extending through bolt 165*a* with upper grip handle 166*a* for the same purpose. A through bolt 165*b* and grip handle 166*b* secures guide assembly part 76*a* that extends into the space between the starwheel plates, enabling separate removal of part 76*a* for ease of changeover. Both the infeed guide assembly and outfeed guide assembly may also be located by pins for ease of properly establishing the proper position of each assembly when installed. The vial starwheel assembly 62 includes a pair of downwardly extending through bolts 172, with upper grip handles 170, for engaging into threaded openings 174 atop the drive mount hub 42. Bottom openings 176 of the vial starwheel assembly 62 may also receive upwardly projecting pins 178 of the drive mount hub 42 for alignment and stabilization purposes. The gate 74 includes bottom openings 171 and 173, one for receiving a mount post 175 of the base system and one for receiving a positioning pin 177 of the base system. The post 175 and pin 177 rotate together (about an axis of the post 175) to position the gate 74.

Referring to syringe changeover component set 60 in FIGS. 9-11 and the base system of FIGS. 1-4, the syringe starwheel assembly 92 includes a pair of downwardly extending through bolts with upper grip handles 180 and may also include bottom openings to receive the drive mount hub pins (comparable to vial starwheel assembly 62). The retaining arm 112 includes a pair of downwardly extending support posts 182 and a corresponding pair of downwardly extending through bolts, which pass through the support posts 182 and have upper grip handles 184. The support posts 182 engage onto the support posts 154 for mounting of the retaining arm 112. The gate 114 includes bottom openings (not shown) to receive the base system post 175 and pin 177 (comparable to gate 74). The mount 111 includes one or more bottom openings (not shown) for engaging one or more upwardly extending pins 186 of the base system. A threaded fastener with grip handle 188 (located on the mount 111) and a threaded fastener with grip handle 190 (located on the retaining arm) provide a clamping feature for clamping the ends of the retaining plate 110 to releasably hold the plate 110 in place. The outfeed diverter 116 may be formed by separate diverter bodies 192 and 194, each of which has one or more bottom openings (not shown) for engaging onto support pins 196 and 198 of the base system. Magnetic retention force may be used in connection with any of the above-described pin and opening connections. Each rail 96 and 98 includes a side-located threaded fastener with grip handle 200, 202 that enables the rails to be clamped onto respective support plates 204, 206 of the base system (e.g., via the upwardly open slots in the support plates). Each rail 119 and 120 includes a respective side located threaded fastener with grip handle 210, 212 that enables the rails to be clamped onto respective support plates 214, 216 of the base system (e.g., via the upwardly open slots in the support plates).

Figure 12:
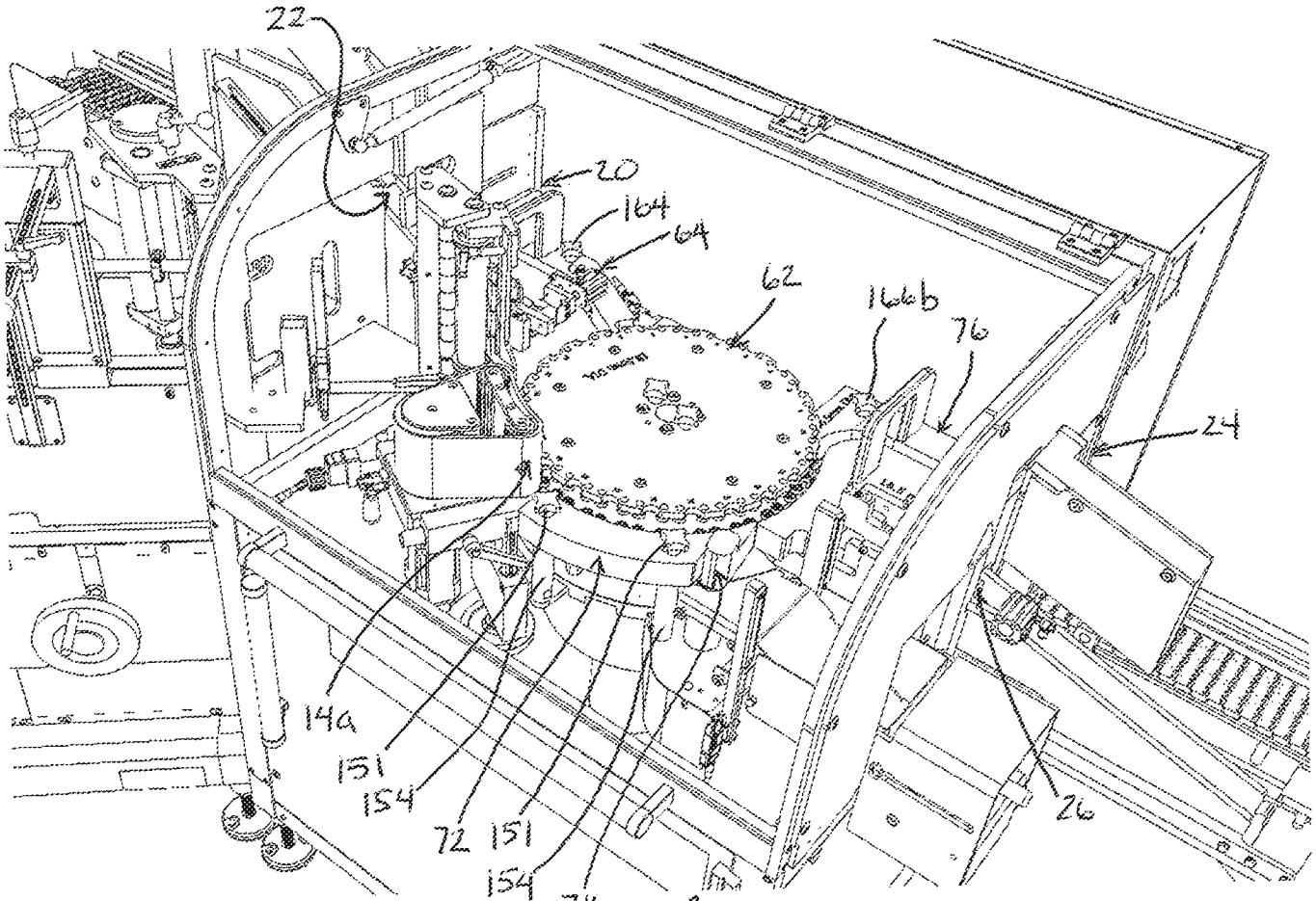
FIG. 12 shows a perspective of the labeling system in vial format.
Figure 13:
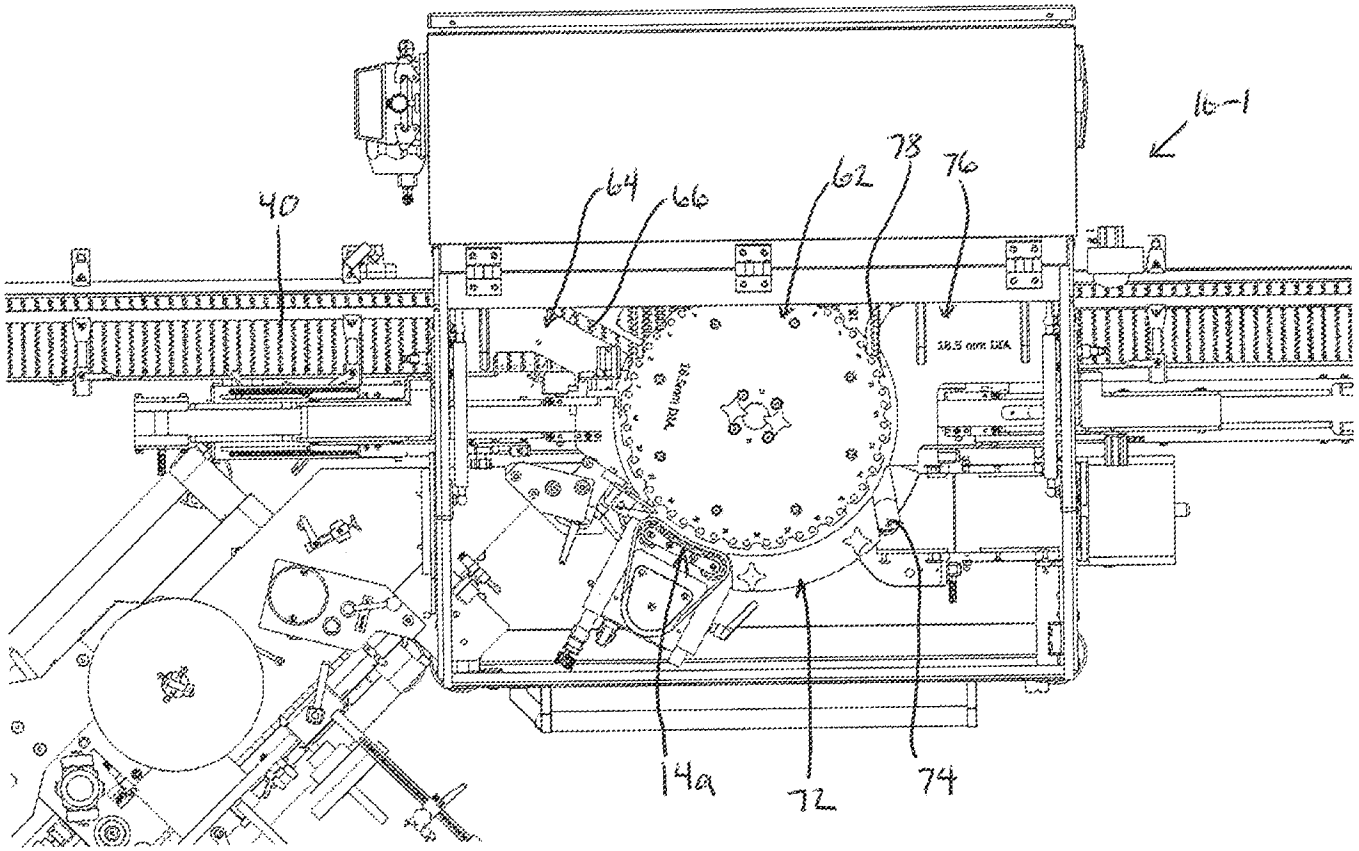
FIG. 13 shows a top plan view of the labeling system in vial format.
Figure 14:
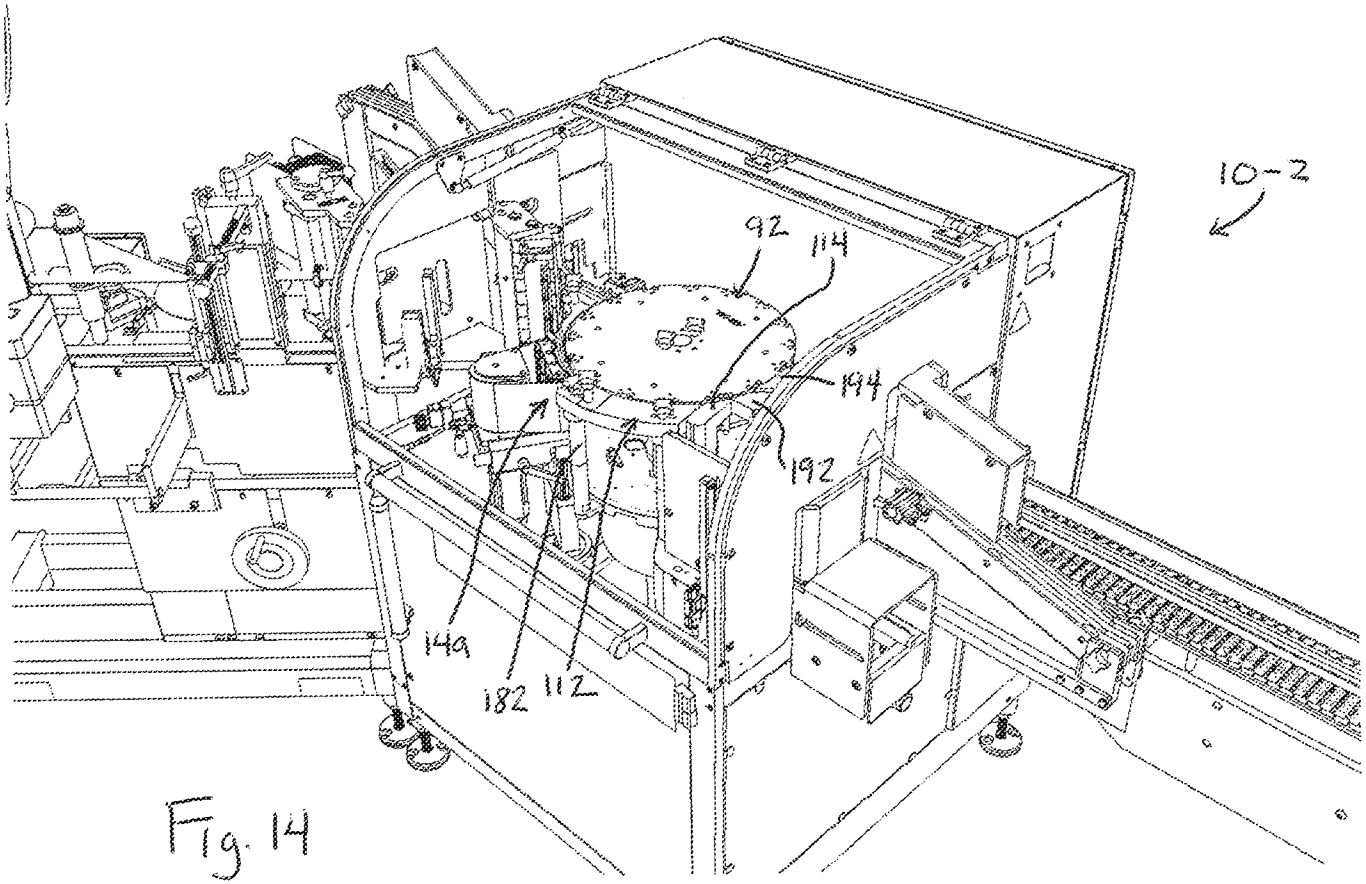
FIG. 14 shows a perspective view of the labeling system in syringe format.
Figure 15:
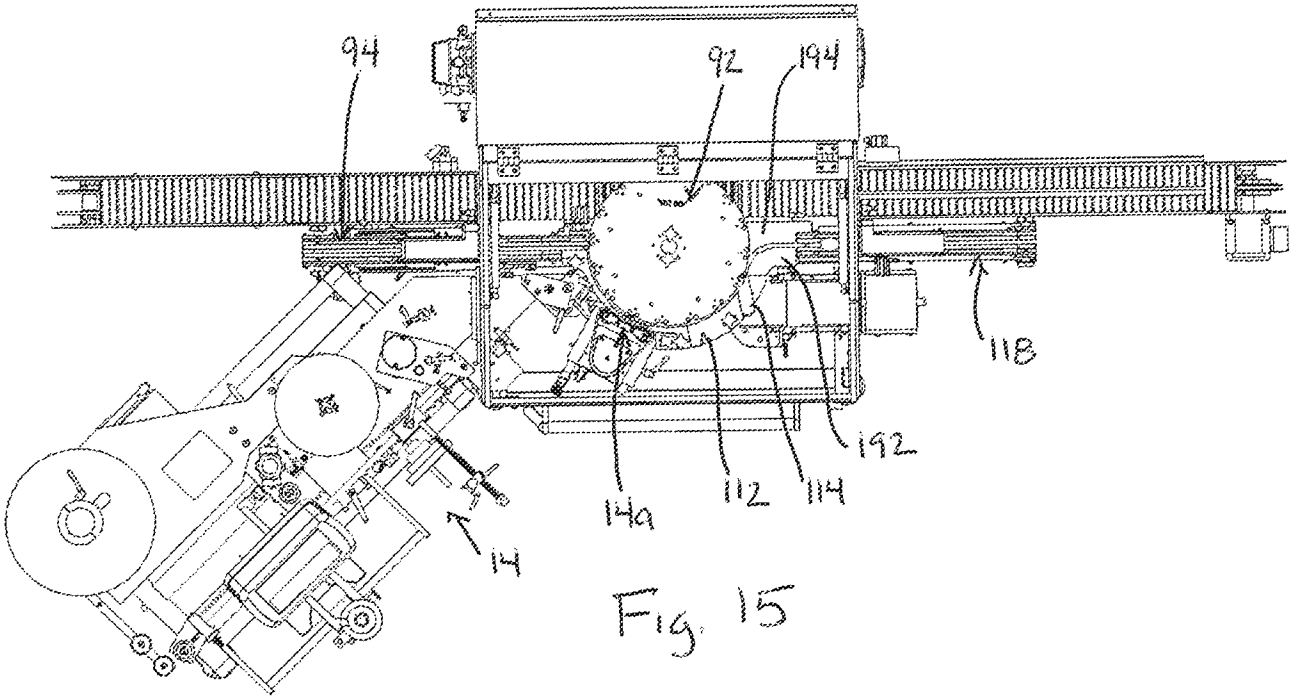
FIG. 15 shows a top plan view of the labeling system in syringe format.

As seen from the above description, all of the changeover components are readily engageable with and removable from the base system of FIGS. 1-4 without requiring the use of any tools. This enables efficient and quick reconfiguration of the labeling system 10 to label either vials or syringes and eliminates the need for two different machines. In this regard, FIGS. 12 and 13 depict the labeling system 10-1 with vial changeover components incorporated (and syringe changeover components removed), resulting in a format configured for vial labeling. FIGS. 14 and 15 show the labeling system 10-2 with syringe changeover components incorporated (and vial changeover components removed), resulting in a format configured for syringe labeling. Changeover from one format to the other simply requires removing the changeover components of the one format, and installing the changeover components of the other format.

Figure 16:
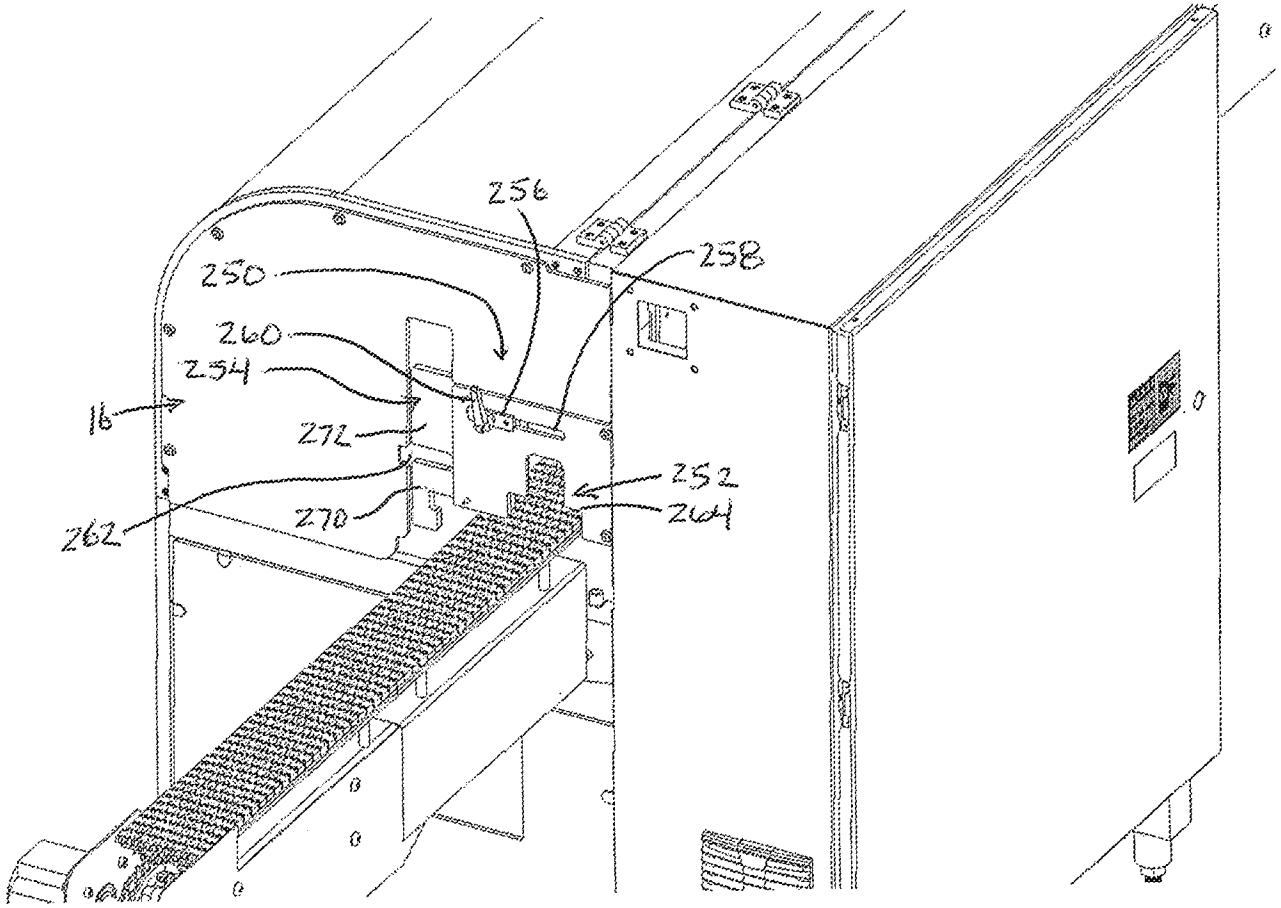
FIGS. 16-21 show a guarding assembly at the outfeed side of the labeling system housing.

In terms of the vial format verses the syringe format of the system, the housing assembly 16 includes a movable guard panel at the infeed side (i.e., where infeed paths 20 and 22 are located) and at the outfeed side (i.e., where outfeed paths 24 and 26 are located) so as to assure that only the infeed and outfeed components for one of the vial or syringe can be placed at a given time. In this regard, FIG. 16 shows the outfeed side of the housing assembly 16 with certain outfeed components (e.g., the rail mount frame 36 and cover 37) removed. As shown, the housing assembly 16 includes a sliding/rolling guard assembly 250 that has a fixed guard panel 252 and a movable guard panel 254. The movable panel 254 is supported by a rail 256 that slides or rolls along a slot 258 of the fixed panel 252, with a locking handle 260 that enables the position of the movable panel along the slot 258 to be locked or released (e.g., by clamping or unclamping).

Figure 17:
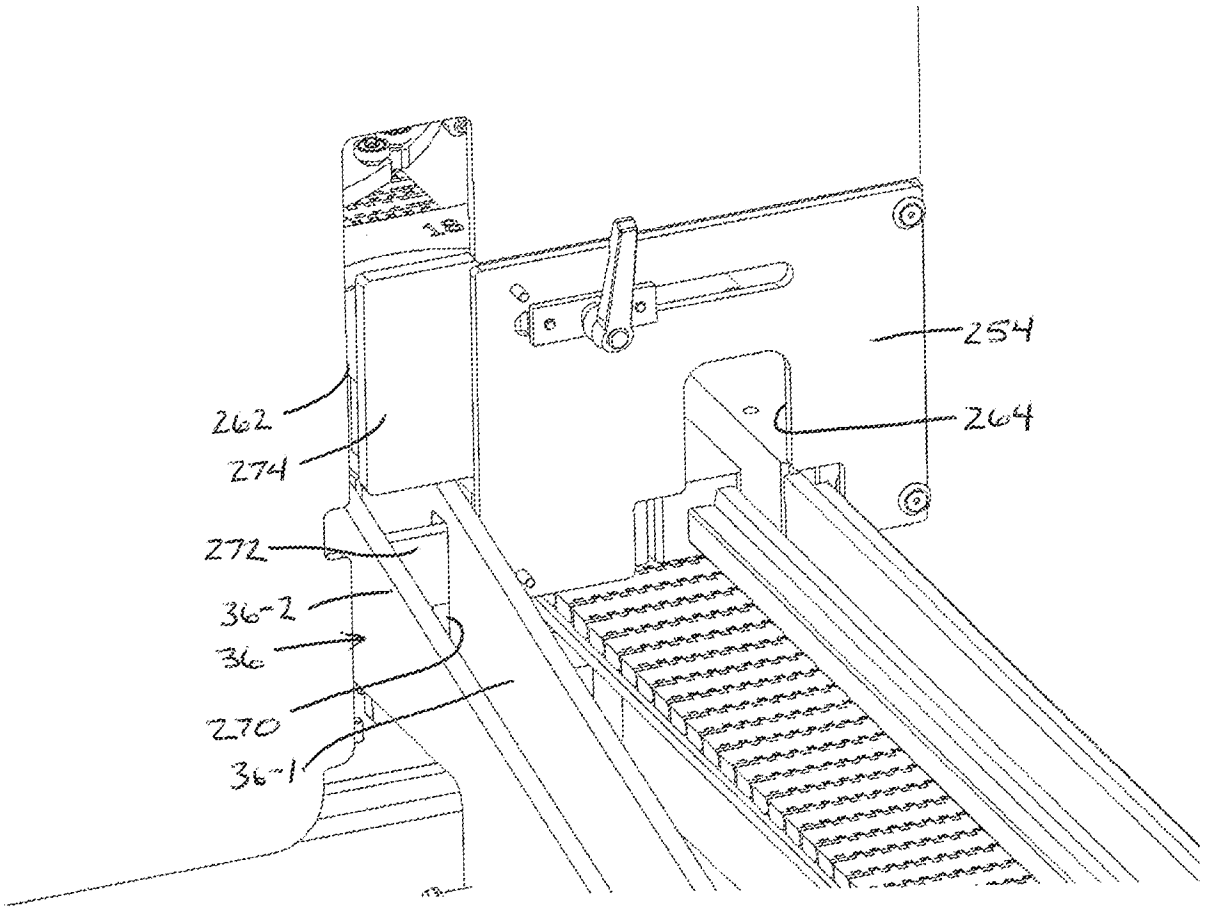
Figure 18:
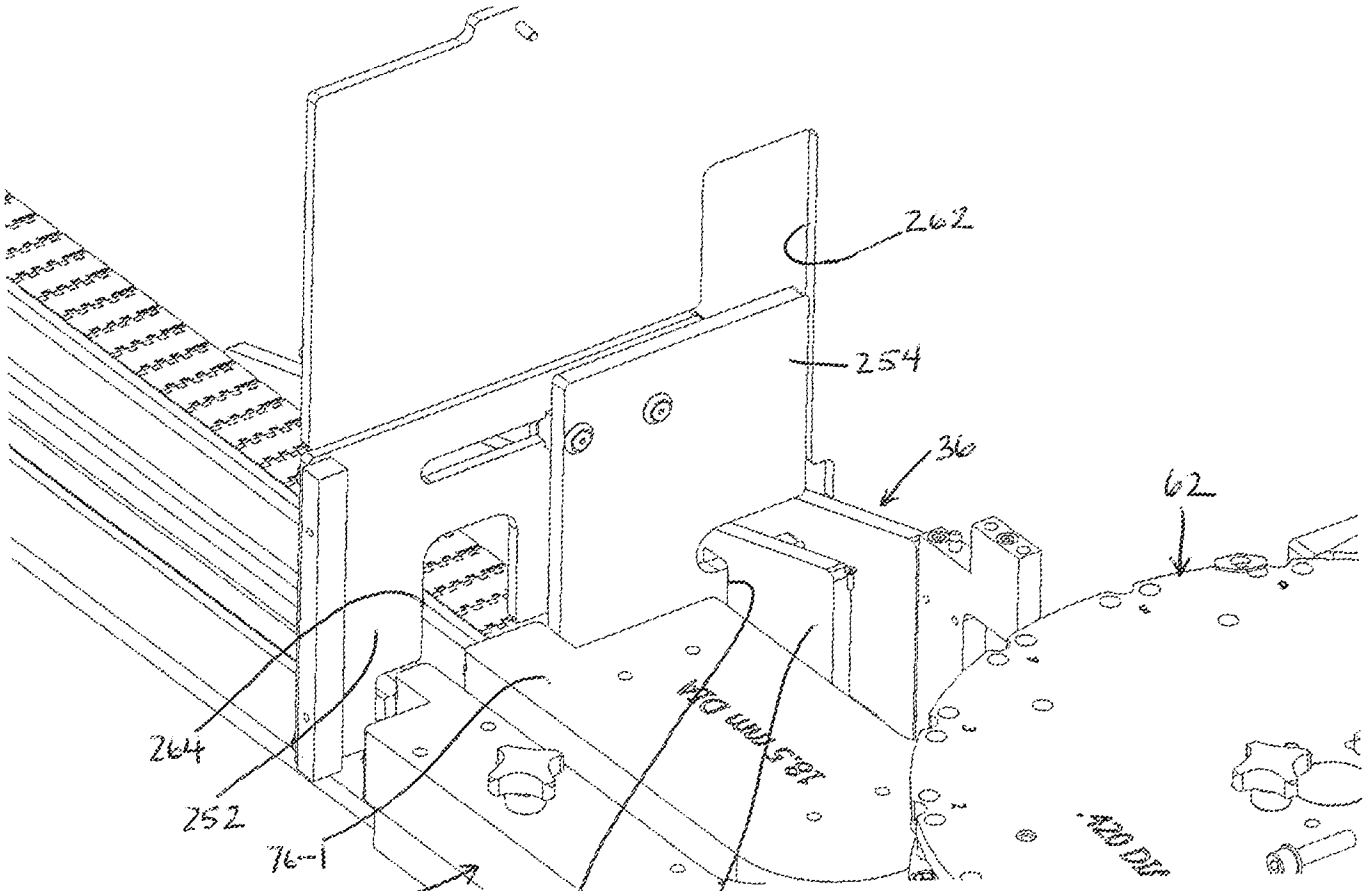
Figure 19:
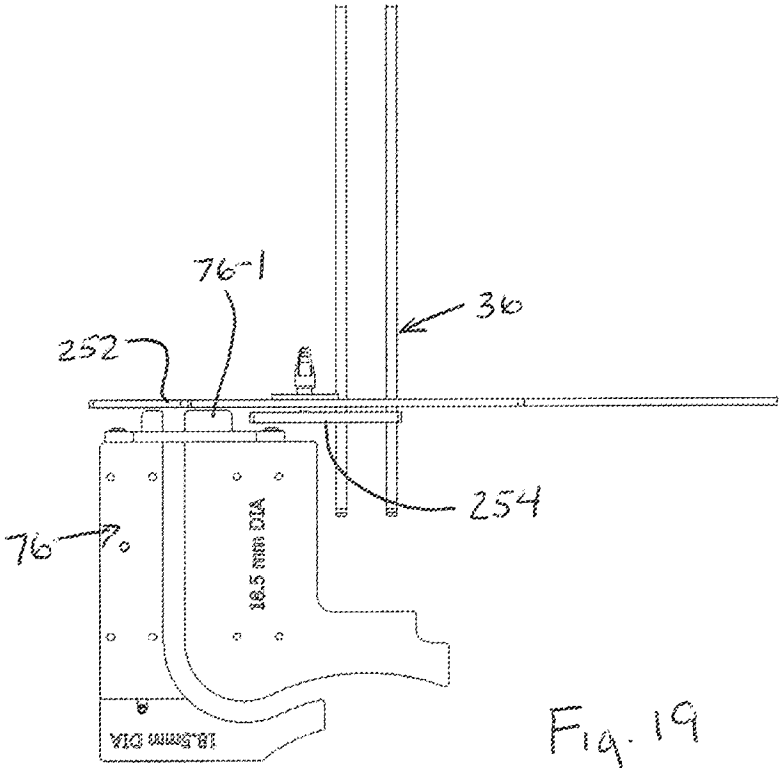

In FIG. 16, the movable panel 254 is positioned such that the panel 254 is blocking a majority of the syringe outfeed path opening 262, and the vial outfeed path opening 264, which is formed in the panel 252, is unblocked. FIGS. 17-19 also show this position of panel 254, with the rail mount frame 36 shown as well. As seen, the frame side plate 36-1 that is positioned closest to the fixed panel 252 includes a slot 270 through which an arm 272 of the moving panel 254 extends in order to block the space between the frame side plates 36-1 and 36-2. The moving panel 254 also includes an upper segment 274 that is positioned above the top of the frame side plates to block that region of the opening 262. In this position of the panel 254, which is the position for the vial format of the labeling system, the outfeed rail set 118 (not shown) cannot be mounted on the rail mount frame 36, and operator access to the interior space of the housing assembly through opening 262 is prevented. In addition, as best seen in FIGS. 18 and 19, end portion 76-1 of the vial outfeed guide assembly 76 is positioned to prevent the movable panel 254 from moving to a position that would unblock the opening 262.

Figure 20:
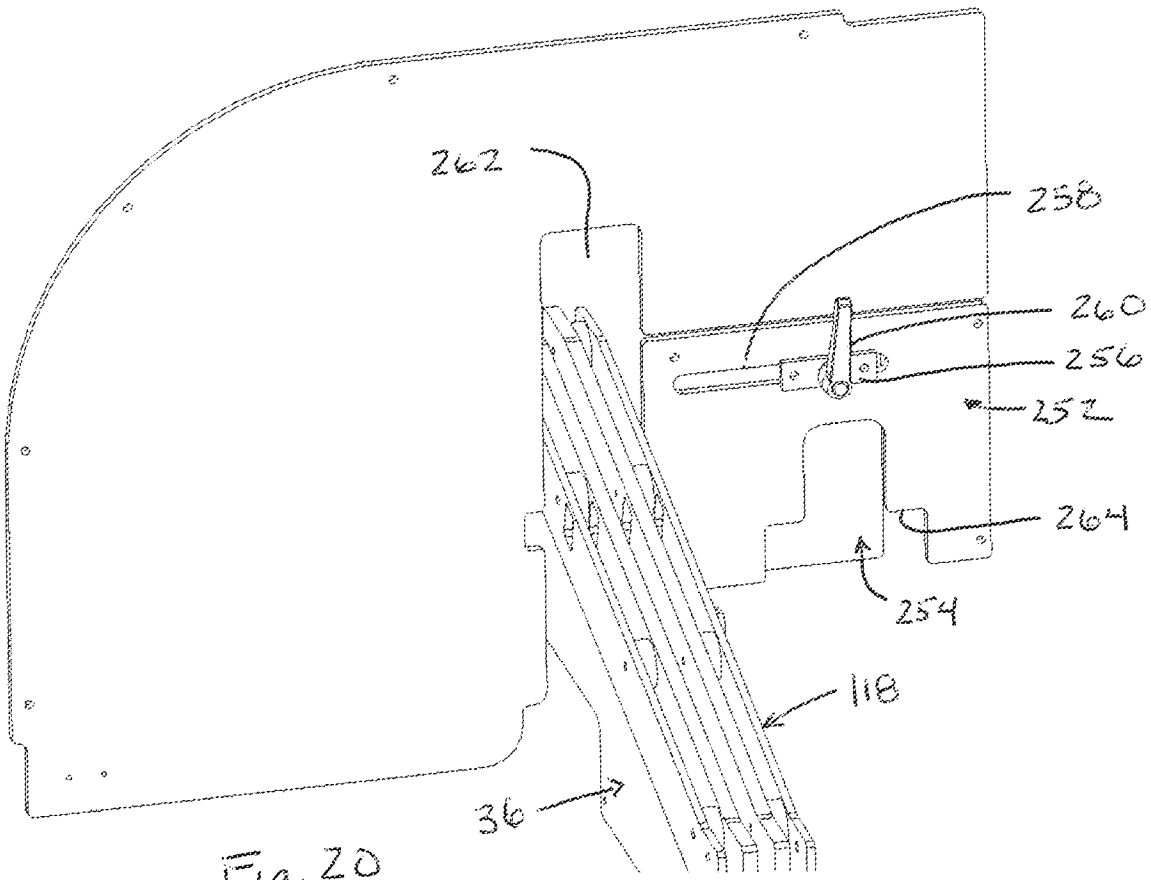
Figure 21:
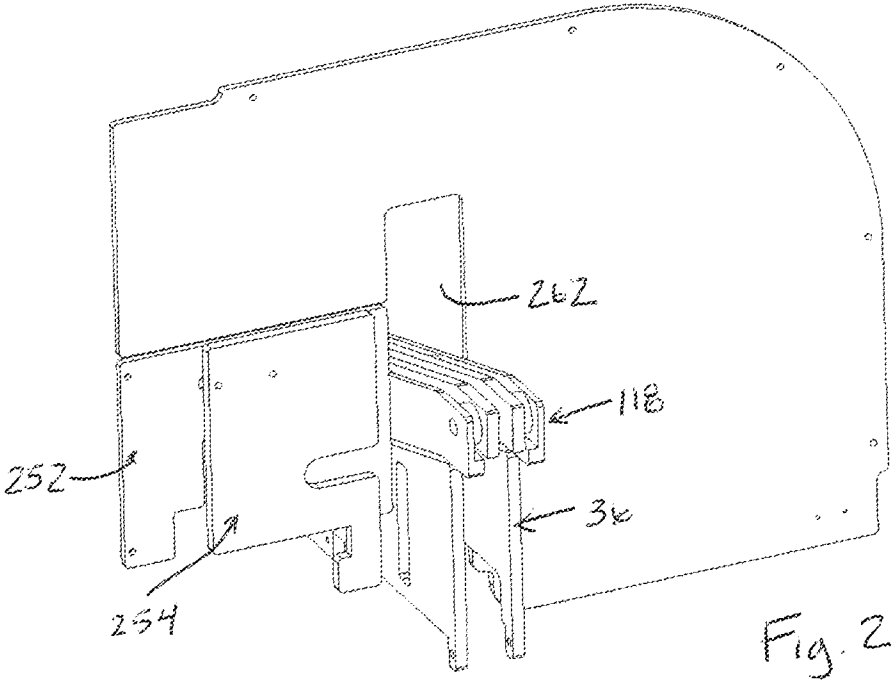

FIGS. 20-21 show the movable panel 254 in position for the syringe format of the labeling system, with the outfeed rail set 118 mounted to the rail mount frame 36. In this position of the movable panel 254, the vial outfeed guide assembly 76 (not shown) cannot be mounted in its use position, and operator access to the interior space of the housing assembly through opening 264 is prevented. In addition, as best seen in FIG. 21, the outfeed rail set 118 is positioned to prevent the movable panel 254 from moving to a position that would unblock the opening 262 (e.g., segment 272 will run up against the side of the rail set 118).

Figure 22:
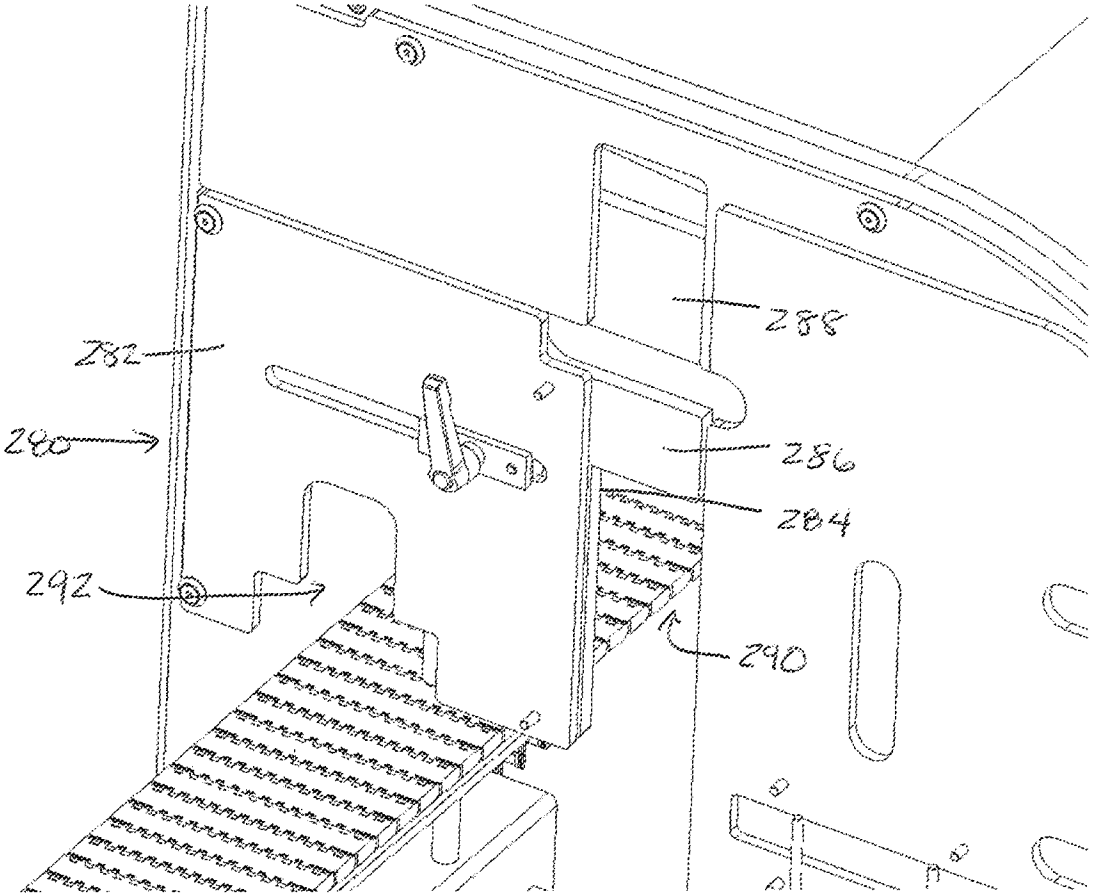
FIG. 22 shows a guarding assembly at the infeed side of the labeling system housing.

Per FIG. 22, a similar sliding/rolling guard assembly 280 is also positioned at the infeed side of the machine and includes a fixed guard panel 282 and movable guard panel 284. In the illustrated position of panel 284, segments 286 and 288 of the panel are blocking portions of the syringe infeed path opening 290 (note that the rail mount frame 32 is not shown but would still be located on the machine when the panel 284 is in this position). The panel 284 is also movable to block the vial infeed path opening 292, which located in fixed panel 282. The function and operation of panel 284 is comparable to that of panel 254 described above.

Thus, both the infeed and outfeed sides of the system housing include a unique and advantageous guarding system that, in some cases, eliminates the need for extended guarding tunnels at the input and output sides of the machine.

It is to be clearly understood that the above description is intended by way of illustration and example only, is not intended to be taken by way of limitation, and that other changes and modifications are possible.

Figure 23:
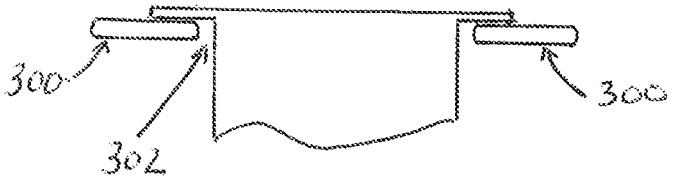
FIG. 23 shows an alternative syringe conveying structure.

For example, although the above illustrated embodiment depicts a syringe infeed and outfeed system that is based upon gravity slide of the syringes on rails, in another embodiment the syringed infeed and the syringed outfeed could also be comprised of conveyor segments. In such an embodiment, the conveyor segments of the syringe infeed path and the syringe outfeed path could both be formed by laterally spaced apart moving or movable conveyor belt portions 300 with a gap 302 therebetween for supporting the syringed with a portion of the syringe barrel hanging downward through the gap, as shown in FIG. 23.

Figure 24:
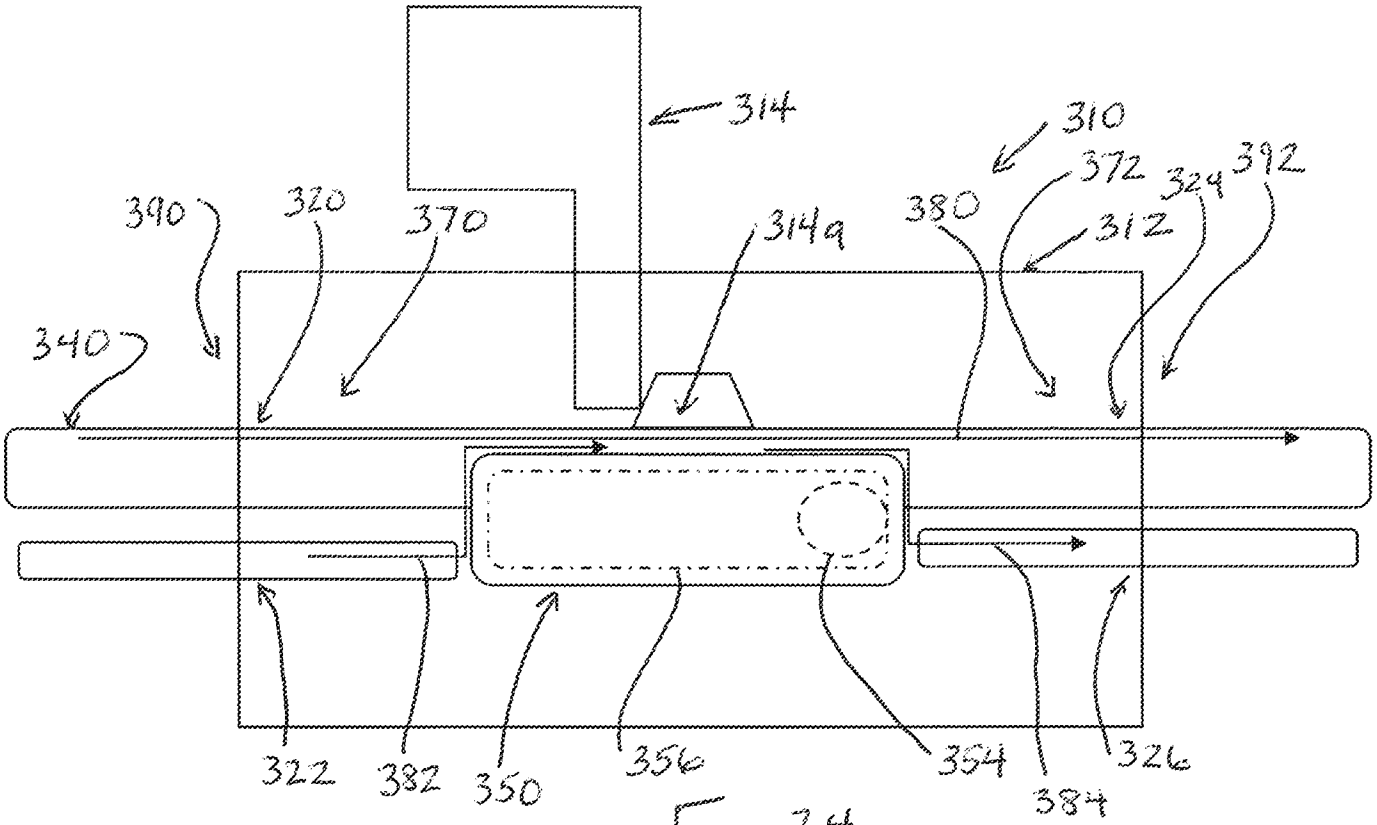
FIG. 24 shows another embodiment of a labeling system.
Figure 25:
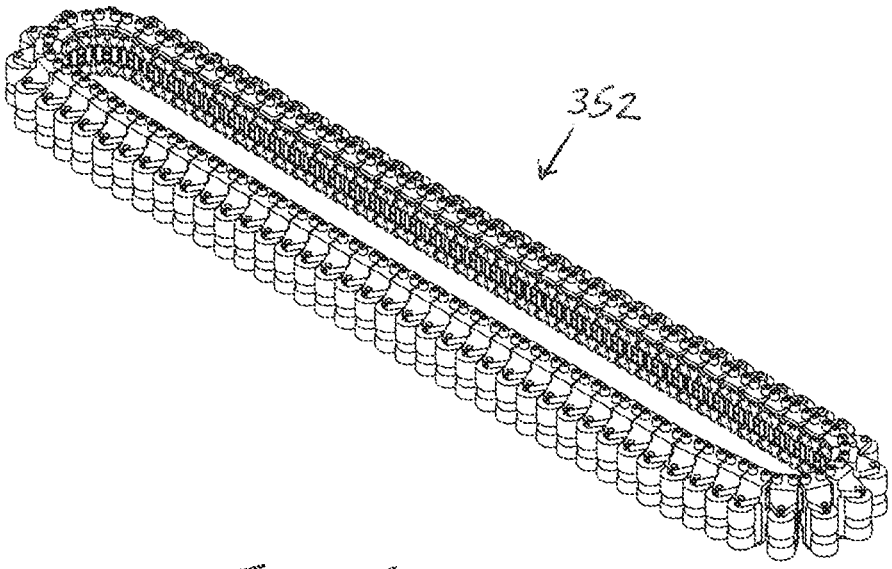
FIG. 25 shows a trunnion chain as an alternative to starwheels.

In addition, while the primary embodiment described above utilizes starwheel assemblies as trunnion parts for supporting and positioning of the containers (vial or syringe) during movement of the containers along the labeling path for labeling, embodiments without starwheel assemblies are also possible. In this regard, FIG. 24 schematically shows a labeling system 310 including a housing assembly 312 and a labeler 314 that feeds labels into the interior of the housing assembly to a labeling station 314*a* (e.g., here with a wrap-belt unit 314*b*). In this system 310, containers move linearly past the labeling station 314*a* for labeling (as opposed to through an arcuate path in the case of system 10 above). A single conveyor 340 passes through the housing assembly 312 at an infeed side 390 and out of the housing assembly at an outfeed side 392, to define the infeed path 320 and outfeed path 324 for the vial type containers (similar to system 10 above). A syringe infeed path 322 is alongside path 320, and a syringe outfeed path 326 is alongside path 322. As above, a sliding rail system or powered conveyor system could be employed for paths 322 and 326. For the purpose of container support during labeling, a looped trunnion part 350 is provided, and may be comprised of chain trunnion 352, such as shown in FIG. 25, which includes container support rollers thereon. The looped trunnion part is driven (e.g., by drive 354) in a looped path 356, part of which moves linearly past the labeling station 314*a*. The general path for vial containers through the system is represented by arrow 380 and the general path for syringe containers through the system is represented by arrows 382 and 384. In this labeling system 310, a set of changeover components for the infeed area 370 would be provided and a set of changeover components for the outfeed area 372 would be provided, in order to facilitate establishing either the vial format or the syringe format of the system. In addition, the housing assembly 312 would include infeed and outfeed guard assemblies similar to those described above for system 10. The chain trunnion itself may also be a changeover part (i.e., one chain trunnion configuration for vials and one chain trunnion configuration for syringes).

While the above described embodiments focus on container types in the nature of a vial and a syringe, systems for handling others container types are also possible, including non-pharmaceutical containers. Other possible bottom supported containers include ampules, cartridges, lip balm and cosmetic tubes. Other possible rim or flange supported containers include test tubes, centrifuges tubes and various containers with oversized caps.

Still other variations are possible.

What is claimed is:

1. A labeling system, comprising:

a rotational drive for rotating a starwheel assembly;

a labeling station positioned for labeling of containers;

a housing assembly around the rotational drive and the labeling station as a guarding enclosure for an interior space of the housing assembly;

a first container infeed path through the housing assembly for feeding a first container type into the interior space for labeling;

a second container infeed path through the housing assembly for feeding a second container type into the interior space for labeling;

a first container outfeed path through the housing assembly for feeding the first container type out of the interior space after labeling;

a second container outfeed path through the housing assembly for feeding the second container type out of the interior space after labeling;

wherein the labeling station is positioned peripherally of the rotational drive at a location that is, in top plan view, both (i) circumferentially between the first infeed path and the first outfeed path and (ii) circumferentially between the second infeed path and the second outfeed path;

wherein, in a first operating configuration of the housing assembly, the first container infeed path is open and the second container infeed path is blocked, and the first container outfeed path is open and the second container outfeed path is blocked.

2. The labeling system of claim 1, wherein the first container type is a vial that is supported at a bottom of the vial during infeed into the interior space and outfeed out of the interior space, and the second container type is a syringe that is supported by hanging from a barrel flange of the syringe during infeed into the interior space and outfeed out of the interior space.

3. The labeling system of claim 1, wherein:

the first infeed path includes a conveyor segment passing through the housing assembly;

the second infeed path includes a downwardly inclined rail mount frame passing through the housing assembly;

the first outfeed path includes a conveyor segment passing through the housing assembly;

the second outfeed path includes a downwardly inclined rail mount frame passing through the housing assembly.

4. The labeling system of claim 1, wherein:

the first container infeed path and the second container infeed path are located on an infeed side of the housing assembly and alongside each other, wherein the first container infeed path is through a first housing assembly infeed opening and the second container infeed path is through a second housing assembly infeed opening;

wherein the housing assembly includes a guard assembly located at the infeed side, wherein the guard assembly includes a moving panel movable between a first guarding position and a second guarding position;

wherein, in the first guarding position, the moving panel blocks the first housing assembly infeed opening and does not block the second housing assembly infeed opening; and wherein, in the second guarding position, which corresponds to the first operating configuration, the moving panel blocks the second housing assembly infeed opening and does not block the first housing assembly infeed opening.

5. The labeling system of claim 1, wherein:

the first container outfeed path and the second container outfeed path are located on an outfeed side of the housing assembly and alongside each other, wherein the first container outfeed path is through a first housing assembly outfeed opening and the second container outfeed path is through a second housing assembly outfeed opening;

wherein the housing assembly includes a guard assembly located at the outfeed side, wherein the guard assembly includes a moving panel movable between a first guarding position and a second guarding position;

wherein, in the first guarding position, the moving panel blocks the first housing assembly outfeed opening and does not block the second housing assembly outfeed opening; and wherein, in the second guarding position, which corresponds to the first operating configuration, the moving panel blocks the second housing assembly outfeed opening and does not block the first housing assembly outfeed opening.

6. The labeling system of claim 1, wherein:

the first infeed path includes a conveyor segment passing through the housing assembly;

the second infeed path includes a conveyor segment passing through the housing assembly;

the first outfeed path includes a conveyor segment passing through the housing assembly;

the second outfeed path includes a conveyor segment passing through the housing assembly.

7. The labeling system of claim 6, wherein:

the conveyor segment of the first infeed path is formed by a first section of a continuous conveyor that passes through the interior space;

the conveyor segment of the first outfeed path is formed by a second section of the continuous conveyor;

the conveyor segment of the second infeed path is formed by laterally spaced apart conveyor portions with a first gap therebetween for supporting the second container type with a portion of the second container type hanging downward through the first gap; and the conveyor segment of the second outfeed path is formed by laterally spaced apart conveyor portions with a second gap therebetween for supporting the second container type with the portion of the second container type hanging downward through the second gap.

8. A labeling system, comprising:

a rotational starwheel drive;

a labeling station positioned for labeling of containers;

a housing assembly around the rotational starwheel drive and the labeling station as a guarding enclosure for an interior space of the housing assembly;

a first container infeed path through the housing assembly for feeding a first container type into the interior space for labeling;

a second container infeed path through the housing assembly for feeding a second container type into the interior space for labeling;

a first container outfeed path through the housing assembly for feeding the first container type out of the interior space after labeling;

a second container outfeed path through the housing assembly for feeding the second container type out of the interior space after labeling;

wherein the labeling station is positioned peripherally of the rotational starwheel drive at a location that is, in top plan view, both (i) circumferentially between the first infeed path and the first outfeed path and (ii) circumferentially between the second infeed path and the second outfeed path;

a first set of changeover components for configuring the labeling system for handling of the first container type, the first set of changeover components including a first starwheel assembly configured to receive and move the first container type around a first arcuate labeling path; and a second set of changeover components for configuring the labeling system for handling of the second container type, the second set of changeover components including a second starwheel assembly configured to receive and move the second container type around a second arcuate labeling path;

wherein, when the first set of changeover components are mounted within the interior space, the labeling system is configured to receive the first container type via the first infeed path, direct the first container type into engagement with the first starwheel assembly such that the first container type is moved around the first arcuate labeling path past the labeling station for labeling, direct the first container type out of engagement with the first starwheel assembly to the first outfeed path for exiting the interior space;

wherein, when the second set of changeover components are mounted within the interior space, the labeling system is configured to receive the second container type via the second infeed path, direct the second container type into engagement with the second starwheel assembly such that the second container type is moved around the second arcuate labeling path past the labeling station for labeling, direct the second container type out of engagement with the second starwheel assembly to the second outfeed path for exiting the interior space.

9. The labeling system of claim 8, wherein:

the rotational starwheel drive includes a drive mount hub;

the first starwheel assembly includes at least one tool free manual fastener for engaging the drive mount hub to removably secure the first starwheel assembly to the drive mount hub;

the second starwheel assembly includes at least one tool free manual fastener for engaging the drive mount hub to removably secure the second starwheel assembly to the drive mount hub.

10. The labeling system of claim 8, wherein:

the first set of changeover components further includes an infeed guide assembly with an arcuate retaining segment for maintaining containers in contact with the first starwheel assembly, an arcuate support rail for supporting a bottom of each container being moved by the first starwheel assembly, an arcuate retaining arm for maintaining each container in contact with the first starwheel assembly, a gate and an outfeed guide assembly;

the second set of changeover components further includes an infeed rail set, an arcuate retaining plate for maintaining containers in contact with the second starwheel assembly, an arcuate retaining arm for maintaining containers in contact with the second starwheel assembly, a gate, an outfeed diverter and an outfeed rail set.

11. A labeling system, comprising:

a drive for moving a trunnion part along a labeling path;

a labeling station positioned for labeling of containers, the labeling station positioned peripherally of the labeling path;

a housing assembly around the drive and the labeling station as a guarding enclosure for an interior space of the housing assembly;

a first container infeed path through the housing assembly, the first container infeed path configured for feeding a first container type into the interior space for labeling;

a second container infeed path through the housing assembly, the second container infeed path configured for feeding a second container type into the interior space for labeling, wherein the second container type is configured differently than the first container type;

a first container outfeed path through the housing assembly, the first container outfeed path configured for feeding the first container type out of the interior space after labeling;

a second container outfeed path through the housing assembly, the second container outfeed path configured for feeding the second container type out of the interior space after labeling;

wherein, in a first operating configuration of the housing assembly, the first container infeed path is open and the second container infeed path is blocked, and the first container outfeed path is open and the second container outfeed path is blocked.

12. The labeling system of claim 11, wherein the drive is one of a drive for rotating a rotational trunnion part or a drive for moving a looped trunnion part.

13. The labeling system of claim 11, wherein the first container type is a container that is supported at a bottom of the container during infeed into the interior space and during outfeed out of the interior space, and the second container type is a container that is supported by hanging from a container flange or rim during infeed into the interior space and during outfeed out of the interior space.

14. The labeling system of claim 13, further comprising:

a first set of changeover components for configuring the labeling system for handling of the first container type; and a second set of changeover components for configuring the labeling system for handling of the second container type.

15. The labeling system of claim 13, wherein:

the first container infeed path and the second container infeed path are located on an infeed side of the housing assembly and alongside each other, wherein the first container infeed path is through a first housing assembly infeed opening and the second container infeed path is through a second housing assembly infeed opening;

wherein the housing assembly includes a first guard assembly located at the infeed side, wherein the first guard assembly includes a first panel movable between a first guarding position of the first panel and a second guarding position of the first panel;

wherein, in the first guarding position of the first panel, the first panel blocks the first housing assembly infeed opening and does not block the second housing assembly infeed opening; and wherein, in the second guarding position of the first panel, which corresponds to the first operating configuration, the first panel blocks the second housing assembly infeed opening and does not block the first housing assembly infeed opening;

the first container outfeed path and the second container outfeed path are located on an outfeed side of the housing assembly and alongside each other, wherein the first container outfeed path is through a first housing assembly outfeed opening and the second container outfeed path is through a second housing assembly outfeed opening;

wherein the housing assembly includes a second guard assembly located at the outfeed side, wherein the second guard assembly includes a second panel movable between a first guarding position of the second panel and a second guarding position of the second panel;

wherein, in the first guarding position of the second panel, the second panel blocks the first housing assembly outfeed opening and does not block the second housing assembly outfeed opening; and wherein, in the second guarding position of the second panel, which corresponds to the first operating configuration, the second panel blocks the second housing assembly outfeed opening and does not block the first housing assembly outfeed opening.

16. A labeling system, comprising:

a labeling station positioned for labeling of containers;

a housing assembly around the labeling station as a guarding enclosure for an interior space of the housing assembly;

a first container infeed path through the housing assembly for feeding a first container type into the interior space for labeling;

a second container infeed path through the housing assembly for feeding a second container type into the interior space for labeling;

a first container outfeed path through the housing assembly for feeding the first container type out of the interior space after labeling;

a second container outfeed path through the housing assembly for feeding the second container type out of the interior space after labeling;

wherein the first container infeed path and the second container infeed path are located on an infeed side of the housing assembly and alongside each other, wherein the first container infeed path is through a first housing assembly infeed opening and the second container infeed path is through a second housing assembly infeed opening;

wherein the housing assembly includes a first guard assembly located at the infeed side, wherein the first guard assembly includes a first panel movable between a first guarding position of the first panel and a second guarding position of the first panel;

wherein, in the first guarding position of the first panel, the first panel blocks the first housing assembly infeed opening and does not block the second housing assembly infeed opening; and wherein, in the second guarding position of the first panel, the first panel blocks the second housing assembly infeed opening and does not block the first housing assembly infeed opening.

17. The labeling system of claim 16, wherein the first container outfeed path and the second container outfeed path are located on an outfeed side of the housing assembly and alongside each other, wherein the first container outfeed path is through a first housing assembly outfeed opening and the second container outfeed path is through a second housing assembly outfeed opening;

wherein the housing assembly includes a second guard assembly located at the outfeed side, wherein the second guard assembly includes a second panel movable between a first guarding position of the second panel and a second guarding position of the second panel;

wherein, in the first guarding position of the second panel, the second panel blocks the first housing assembly outfeed opening and does not block the second housing assembly outfeed opening; and wherein, in the second guarding position of the second panel, the second panel blocks the second housing assembly outfeed opening and does not block the first housing assembly outfeed opening.

18. A labeling system, comprising:

a rotational drive for rotating a starwheel assembly;

a labeling station positioned for labeling of containers;

a housing assembly around the rotational drive and the labeling station as a guarding enclosure for an interior space of the housing assembly;

a first container infeed path through the housing assembly for feeding a first container type into the interior space for labeling;

a second container infeed path through the housing assembly for feeding a second container type into the interior space for labeling;

a first container outfeed path through the housing assembly for feeding the first container type out of the interior space after labeling;

a second container outfeed path through the housing assembly for feeding the second container type out of the interior space after labeling;

wherein the labeling station is positioned peripherally of the rotational drive at a location that is, in top plan view, both (i) circumferentially between the first infeed path and the first outfeed path and (ii) circumferentially between the second infeed path and the second outfeed path;

wherein the housing assembly includes a guard assembly including a portion movable between a first guarding position and a second guarding position;

wherein, in the first guarding position, the portion blocks the first container infeed path and does not block the second container infeed path; and wherein, in the second guarding position, the portion blocks the second container infeed path and does not block the first container infeed path.

* * * * *